US005825289A

United States Patent [19]

Riordan

[11] Patent Number: 5,825,289

[45] Date of Patent: Oct. 20, 1998

[54] COMBINED ALARM SYSTEM AND WINDOW COVERING ASSEMBLY

[76] Inventor: Dennis E. Riordan, 2326 Sawtelle Blvd., Los Angeles, Calif. 90064

[21] Appl. No.: 188,397

[22] Filed: Jan. 27, 1994

Related U.S. Application Data

[63] Continuation-in-part of Ser. No. 920,837, Jul. 28, 1992, which is a continuation-in-part of Ser. No. 831,861, Feb. 5, 1992, Pat. No. 5,274,357.

[51] Int. Cl.[6] ..... G08B 13/12

[52] U.S. Cl. ..... 340/550; 160/10; 248/300; 248/315; 335/205; 340/545; 340/547

[58] Field of Search ..... 340/550, 545, 340/547; 160/10; 248/300, 315, 200; 335/205

[56] References Cited

U.S. PATENT DOCUMENTS

| | | | |
|---|---|---|---|
| 3,051,935 | 8/1962 | Willson | 340/550 |
| 3,911,990 | 10/1975 | Hoover et al. | 160/100 |
| 4,146,293 | 3/1979 | Mutton et al. | 340/550 |
| 4,232,309 | 11/1980 | Dillitzer | 340/547 |
| 4,232,310 | 11/1980 | Wilson | 340/550 |
| 4,234,875 | 11/1980 | Williams | 340/550 |
| 4,281,320 | 7/1981 | Rosenberg | 340/547 |
| 4,293,778 | 10/1981 | Williams | 340/550 |
| 4,582,109 | 4/1986 | Fairbanks | 160/84.1 C |
| 4,677,013 | 6/1987 | Anderson | 160/84.1 D |
| 4,687,039 | 8/1987 | Chumbley | 160/84.1 C |
| 4,839,632 | 6/1989 | Zahn, Jr. et al. | 200/61.81 |
| 4,861,404 | 8/1989 | Neff | 156/292 |
| 4,909,298 | 3/1990 | Langhart et al. | 160/178.12 |
| 4,913,210 | 4/1990 | Colson et al. | 160/178.2 |
| 4,974,656 | 12/1990 | Judkins | 160/84.1 C |
| 4,982,776 | 1/1991 | Kuhar et al. | 160/178.2 |
| 4,999,608 | 3/1991 | Galomb | 340/550 |
| 5,005,000 | 4/1991 | Riordan | 340/550 |

*Primary Examiner*—Glen Swann
*Attorney, Agent, or Firm*—W. Edward Johansen

[57] ABSTRACT

A combined alarm system and window covering assembly includes a top housing, a bottom rail, a covering, an alarm element, a pull cord which is slidably coupled to the top housing and a resiliently biased reed relay switch. The resiliently biased reed relay switch includes a tube which has a first end and a second end which is crimped and which is mechanically coupled to an end of the bottom rail, an encapsulated reed relay switch which has a first end with a first conductive lead and a second end with a second conductive lead and which is fixedly coupled to the pull cord and slidably disposed within the tube and a spring which has a first end and a second end and which is disposed in the tube so that the first end of the spring is adjacent to the second end of the tube and the second end of the spring is adjacent to the first end of the encapsulated reed relay switch. Both of the first and second conductive leads are coupled to the alarm element. The resiliently biased reed relay switch couples the pull cord to the bottom rail.

8 Claims, 17 Drawing Sheets

Fig. 11
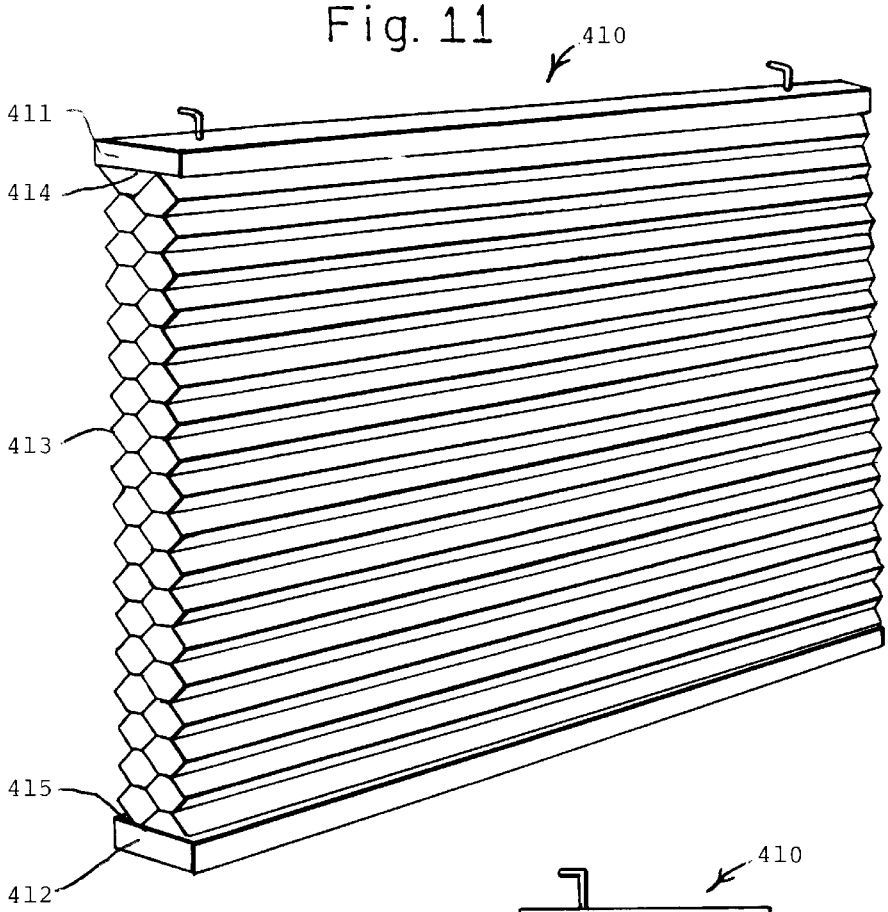
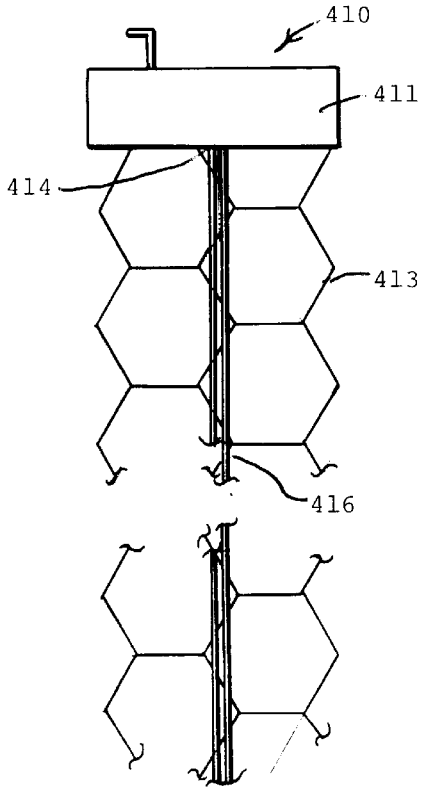
Fig. 12.

COMBINED ALARM SYSTEM AND WINDOW COVERING ASSEMBLY

This application is a continuation-in-part of the application filed Jul. 28, 1992 under Ser. No. 07/920,837 which is a continuation-in-part of the application filed Feb. 5, 1992 under Ser. No. 07/831,861, now U.S. Pat. No. 5,274,357, issued Dec. 28, 1993.

BACKGROUND OF THE INVENTION

The field of the invention is combined alarm systems and window covering assemblies.

U.S. Pat. No. 4,582,109 teaches an accordion fold type decorative fabric drapery system which has a pair of drapery sections of decorative weave fabric sheets specially formed into sharply pleated accordion-like folds to provide a large number of vertically elongated narrow panels resembling in size the slats or louvers of a vertical blind system. U.S. Pat. No. 4,677,013 teaches a honeycomb structure which is formed of a continuous length of foldable material which is folded into a Z-configuration and which is stacked in layers which are adhered together. These layers form longitudinally extending cells, one on top of the other, of the honeycomb structure. U.S. Pat. No. 4,861,404 teaches a honeycomb product.

U.S. Pat. No. 4,687,039 teaches a pleated shade in which there is a vacuum deposited aluminized surface. The first and second pleated sheets are arranged so that the corresponding aluminized surfaces face one another within the second pleated shade so that the second pleated shade has a significant resistance to heat loss or gain, if properly installed, and is decorative and distinctive in appearance. U.S. Pat. No. 4,982,776 and U.S. Pat. No. 4,913,210 teach a cord lock for a pleated shade. U.S. Pat. No. 4,974,656 teaches a pleated shade.

U.S. Pat. No. 4,839,632 teaches a combined alarm system and screen assembly which has mounting brackets at the corners and a pair of substantially rigid opposite end piece assemblies on which a screen mesh can be rolled up. At each corner a circuit closing mechanism acts between the bracket there and the adjacent end piece assembly to close circuit of an alarm device through electrical wiring in the screen only when that end piece assembly is held by the bracket. U.S. Pat. No. 3,911,990 teaches a window and screen combination.

U.S. Pat No. 4,146,293 teaches a combined alarm system and screen assembly includes a frame and a screen mesh. The combined alarm system and screen assembly includes a continuous length of conductive wire which may be sewn, glued or interwoven onto the screen mesh in order to fix it in place and which provide a series circuit. U.S. Pat. No. 4,232,310, U.S. Pat. No. 3,051,935 and U.S. Pat. No. 5,005,000 all teach combined alarm system and screen assemblies in which the continuous length of conductive wire may be interwoven, glued by an air hardening process and/or sewn onto the screen mesh.

U.S. Pat. No. 4,234,875 teaches a security panel arrangement for use with an intrusion alarm system which is designed to monitor the continuity of a normally continuous signal conductive path and to produce a warning signal when the signal conductive path is broken, which arrangement includes a cellular panel forming a series of parallel elongated passages through which extends at least one means for conducting a signal. The cellular panel is attached to a surface portion of a structure to be secured, and the means for conducting a signal is connected at its two ends to the alarm system in a continuity monitoring relationship therewith. Passage of a human being through the surface portion breaks the continuity of the means for conducting a signal and causes the alarm system to produce the warning signal.

U.S. Pat. No. 4,293,778 teaches a partially conductive security screen arrangement for use with an intrusion alarm system designed to operate in a normally closed sensing circuit condition and to produce a warning signal when the sensing circuit is broken, which arrangement includes conductive means overlying and bonded to a mesh screen positionable to cover an opening in a building. The conductive means is connectable at its two ends to the sensing circuit in a series relationship with the remainder of that circuit. The conductive means is positioned on the screen in a configuration preventing passage of a human being through the screen unless the conductive means is severed. Passage of a human being through the opening while the screen is in position to cover the opening therefore breaks the sensing circuit to produce a warning signal. One or more electrical switches located within a frame at the periphery of the screen may also be connected in a series relationship with the remainder of the sensing circuit, the switches being adapted to close for the screen in position covering the opening in the building and to open for the screen moved out of that position. The conductive means may include a plurality of parallel longitudinal lengths of wire connected in series with each other and with one or more transverse lengths of wire. The respective lengths of wire may be mechanically interlocked with each other and with the mesh screen at the points of intersection therebetween.

U.S. Pat. No. 4,999,608 teaches an electrically conductive security screen which includes an electrical resistance sensor and alarm to detect tampering with the screening material of a window. An elongated path of flexible and electrically conductive coating composition is applied to the screening material in a predetermined and non-overlapping pattern, such that a closed circuit loop is formed when it is attached to the sensor alarm. The coating has an electrical resistance that varies when it is distorted or its path interrupted.

U.S. Pat. No. 4,909,298 teaches a safety device which is attached to the pull cords for window coverings to prevent children from strangling when the children play with the pull cords. The safety device may be removably attached to the frame of window coverings and may be formed to retain the cords in a looped configuration displaced from children's reach.

SUMMARY OF THE INVENTION

The present invention is generally directed to a combined alarm system and window covering assembly which is visually identical to a window covering assembly having a top housing assembly, a bottom housing assembly, a covering, an alarm element, a pull cord and a resiliently biased reed relay switch. The alarm element is a conductive wire which extends from the top housing assembly down to the bottom housing assembly and up from the bottom housing assembly to the top housing assembly.

In a first separate aspect of the present invention, the resiliently biased reed relay switch includes a tube which has a first end and a second end which is crimped and which is mechanically coupled to an end of the bottom rail, an encapsulated reed relay switch which has a first end with a first conductive lead and a second end with a second conductive lead and which is fixedly coupled to the pull cord and slidably disposed within the tube and a spring which has a first end and a second end and which is disposed in the tube so that the first end of the spring is adjacent to the second end of the tube and the second end of the spring is adjacent to the first end of the encapsulated reed relay switch. Both of the first and second conductive leads are coupled to the alarm element. The resiliently biased reed relay switch couples the pull cord to the bottom rail.

In a second separate aspect of the present invention, the resiliently biased reed relay switch is electrically coupled to the conductive wire.

In a third separate aspect of the present invention, the conductive wire is disposed in the pull cord.

In a fourth separate aspect of the present invention, a magnet holding and bottom rail bracket includes a bracket and a magnet. The bracket has a base having a plurality of holes, a support having a plurality of holes and a flange having a hole. The base, the support and the flange are orthogonally disposed to each other. The support is fixedly coupled to the base. The flange is fixedly coupled to the support. The magnet is disc-shaped and has a hole therein. The hole in the magnet is aligned with the hole in the flange. The magnet is fixedly coupled to the flange.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE DRAWINGS

FIG. 11 is a perspective drawing of a combined alarm system and shade assembly which includes a double honeycomb shade and an optical fiber.

FIG. 12 is a partial side elevational view in cross-section of the combined alarm system and shade assembly of FIG. 11.

DESCRIPTION OF THE PREFERRED EMBODIMENT

Figure 1:
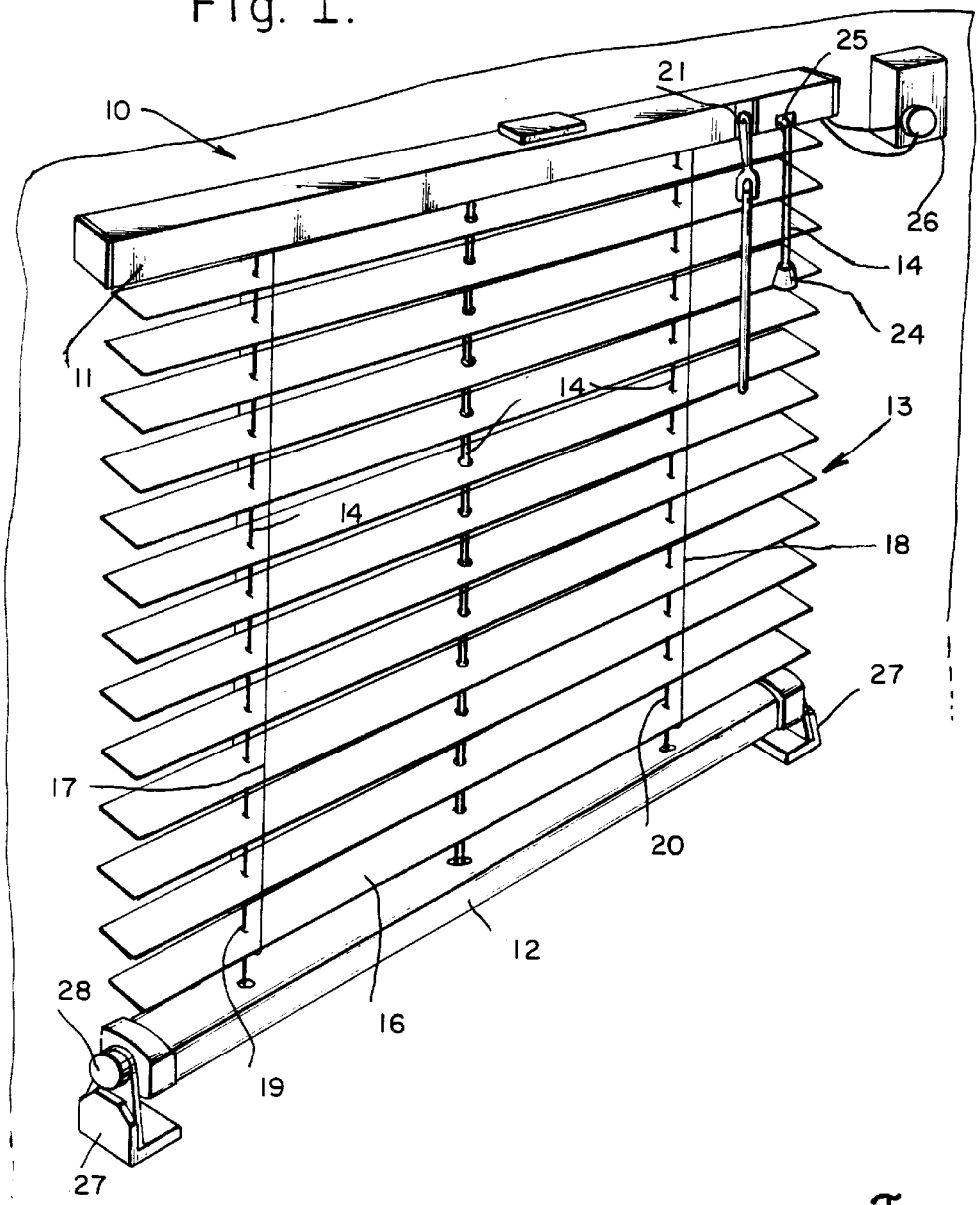
FIG. 1 is a perspective drawing of a combined alarm system and blind assembly which includes a plurality of slats, a top housing assembly having a resiliently biased reed relay switch, a bottom rail having a resiliently biased reed relay switch and a conductive wire.
Figure 2:
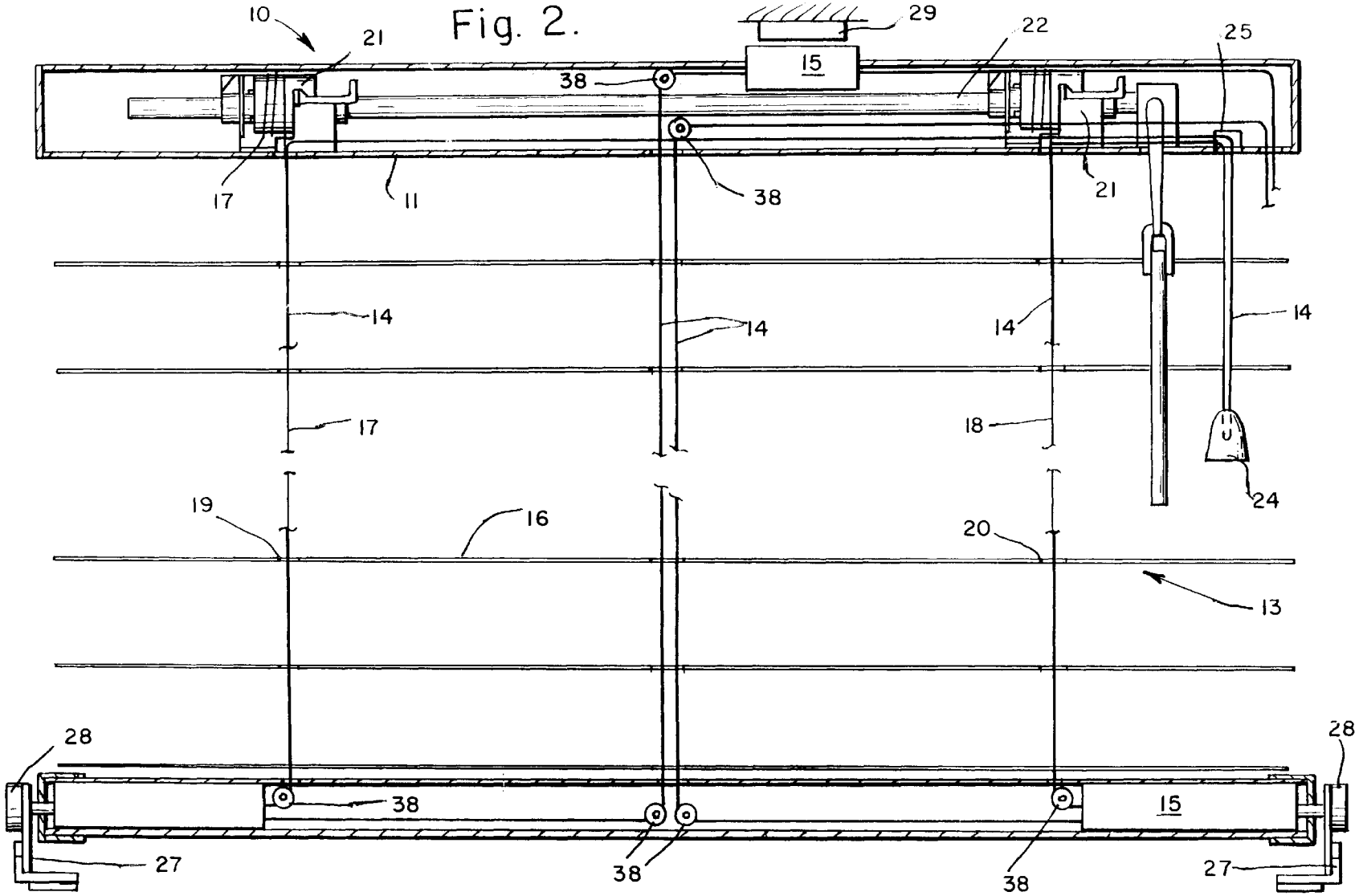
FIG. 2 is an elevational view in cross-section of the combined alarm system and blind assembly of FIG. 1.

Referring to FIG. 1 in conjunction with FIG. 2 a combined alarm system and window covering assembly 10 includes a top housing 11, a bottom rail 12 having two ends, a covering 13, a conductive wire 14 and three resiliently biased reed relay switches 15. The covering 13 is mechanically coupled to the top housing 11 and the bottom rail 12. The conductive wire 14 extends from the top housing 11 down to the bottom rail 12 and up from the bottom rail 11 to the top housing 11. The conductive wire 14 functions as a pull cord for raising and lowering the bottom rail 12.

Still referring to FIG. 1 in conjunction with FIG. 2 the covering 13 includes a plurality of individual slats 16, a first string ladder support system and a second string ladder support system 18. Each slat 16 has a first slot 19 and a second slot 20, which is spaced apart from the first slot 19. The first string ladder support system 17 has a front vertical ladder string and a back vertical ladder string with short support strings fastened between the front and back vertical ladder strings. The first string ladder support system 17 is mechanically coupled to the top housing 11 and the bottom rail 12. Each short support string of the first string ladder support system 17 supports one of the slats 16 contiguous to the first slot 19 thereof. The second string ladder support system 18 has a front vertical ladder string and a back vertical ladder string with short support strings fastened between the front and back vertical ladder strings. The second string ladder support system 18 is mechanically coupled to the top housing 11 and the bottom rail 12. Each short support string of the second string ladder support system 18 supports one of the slats 16 contiguous to the second slot 20 thereof. The conductive wire 14 extends from the top housing 11 down through each of the first slots 19 of the slats 16 to the bottom rail 12 and from the bottom rail 12 through each of the second slots 20 of the slats 15 to the top housing 11. The top housing 11 has a tilting mechanism 21, a tilt rod 22 and a pull string assembly 23 disposed therein. The tilt rod 22 is mechanically coupled to the tilting mechanism 21 and is fixedly coupled to the first and second string ladder support systems 17 and 18. The pull string assembly 23 includes a pull tab 24, a conductive wire 14 and a cord lock unit 25. The conductive wire 14 is mechanically coupled to the pull tab 24. The cord lock unit 25 is disposed in the top housing 11 and mechanically coupled thereto. An alarm device 26 has a first input terminal and a second input terminal. The first and second ends of the conductive wire 14 are electrically coupled to the first and second input terminals, respectively, of the alarm device 26.

Figure 3:
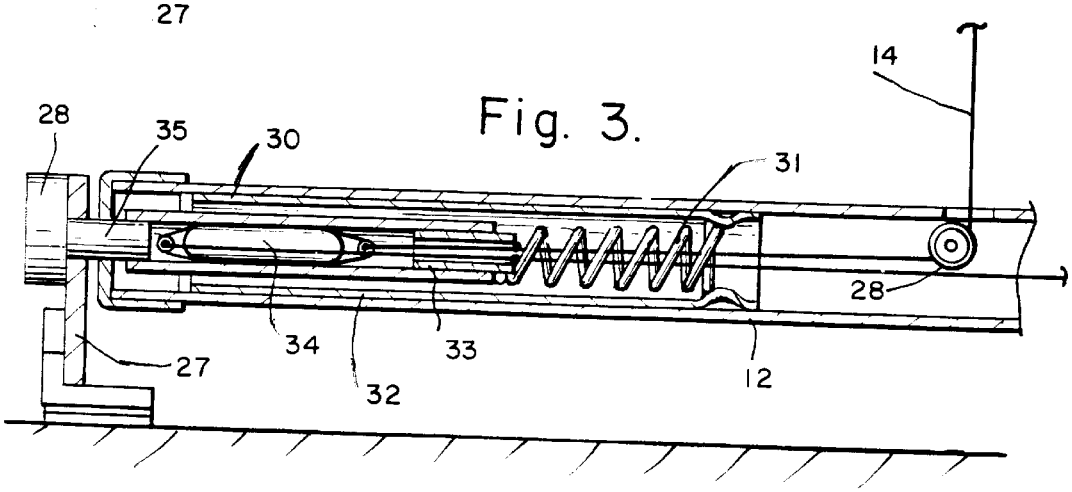
FIG. 3 is an enlarged, partial elevational view in cross-section of the combined alarm system and blind assembly of FIG. 1.

Referring to FIG. 3 in conjunction with FIG. 1 and FIG. 2 there is a magnet 29 disposed above the top housing 11. Each resiliently biased reed relay switch 15 includes a includes a housing 30, a spring 31, a plunger 32, a spacer 33, a reed-relay switch 34 and a removable cap 35. The reed-relay switch 34 is disposed in the plunger 32. The removable cap 35 covers one of the ends of the plunger 32. The spring 31 is coupled to the plunger 32 by the spacer 33 at its other end and resiliently couples the plunger 32 to the housing 30. The plunger 32 is slidably coupled to the housing 30. There are two end pieces 36 each of which has a hole 37 and is coupled to one of the ends of the bottom rail 12. When used in the bottom rail 12 the removable pin 35 projects from the hole 37 in one of the end pieces 36. When used in the top housing 11 the removable pin 35 is removed. The reed-relay switch 34 is electrically coupled to the conductive wire 14. There are rollers 38 disposed through the path of the conductive wire 14.

Figure 4:
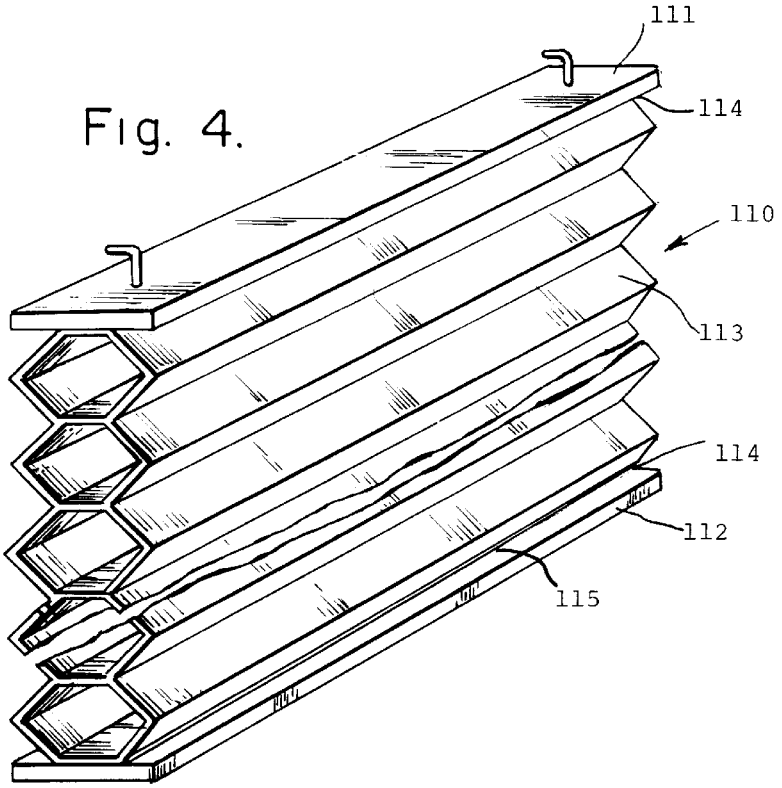
FIG. 4 is a partial perspective drawing of a combined alarm system and shade assembly which includes a single honeycomb shade and a conductive wire.
Figure 5:
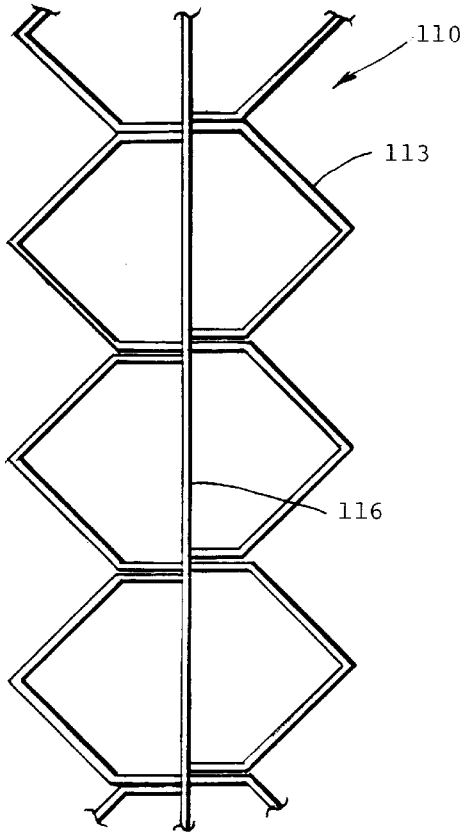
FIG. 5 is a partial side elevational view of the combined alarm system and shade assembly of FIG. 4.

Referring to FIG. 4 in conjunction with FIG. 5 a combined alarm system and shade assembly 110 includes a top housing assembly 111, a bottom housing assembly 112, a single honeycomb shade 113 having a top edge 114 and a bottom edge 115 and a conductive wire 116. The single honeycomb shade 113 is mechanically coupled to the top housing assembly 111 adjacent to the top edge 114 thereof. The single honeycomb shade 113 is mechanically coupled to the bottom housing assembly 112 adjacent to the bottom edge 115 thereof. The conductive wire 116 has a first end and a second end and extends from the top housing assembly 111 down to the bottom housing assembly 112 and from the bottom housing 112 to the top housing assembly 111. The conductive wire 116 makes a plurality of round-trips each of which extends from the top housing assembly 111 down through the single honeycomb shade 113 to the bottom housing assembly 112 and from the bottom housing assembly 112 up through the single honeycomb shade 113 to the top housing assembly 111.

Figure 6:
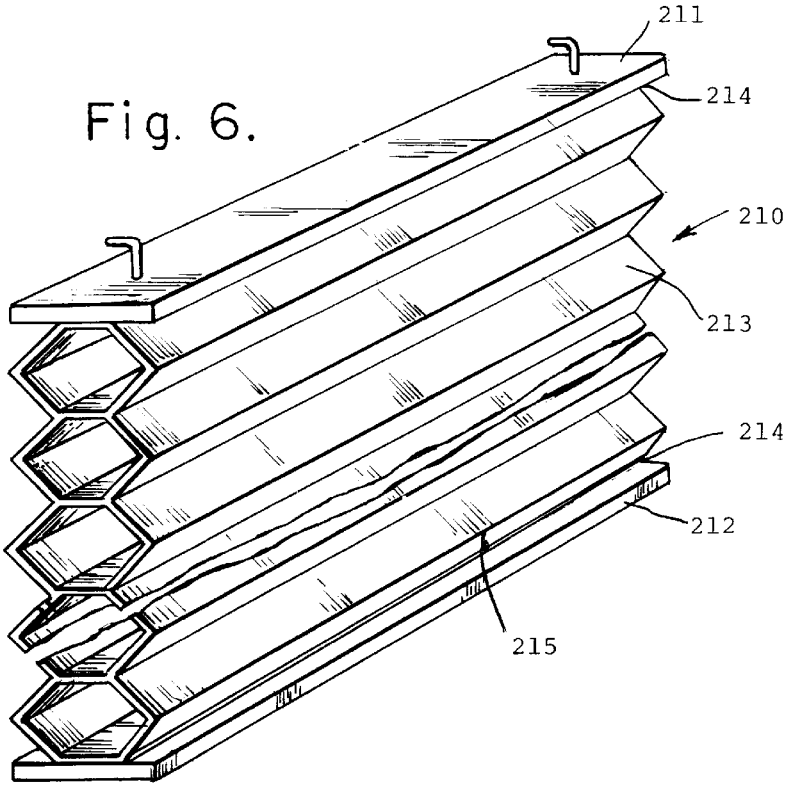
FIG. 6 is a partial perspective drawing of a combined alarm system and shade assembly which includes a single honeycomb shade and an optical fiber.
Figure 7:
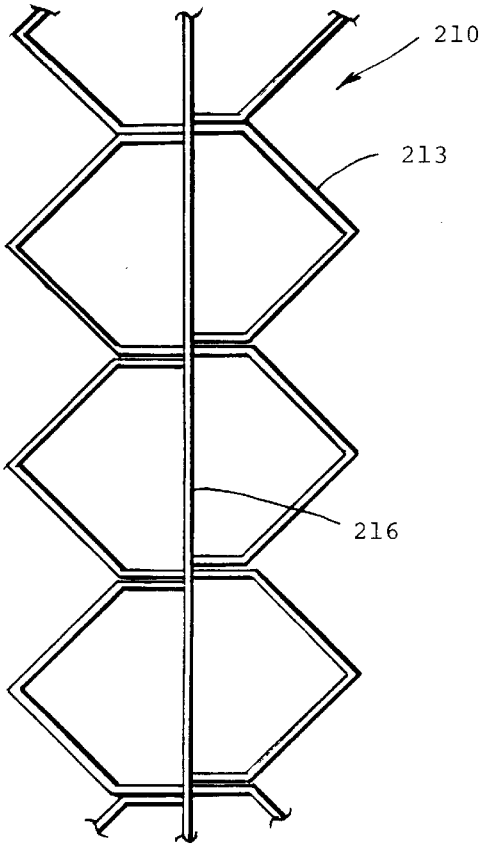
FIG. 7 is a partial side elevational view of the combined alarm system and shade assembly of FIG. 6.

Referring to FIG. 6 in conjunction with FIG. 7 a combined alarm system and shade assembly 210 includes a top housing assembly 211, a bottom housing assembly 212, a single honeycomb shade 213 having a top edge 214 and a bottom edge 215 and an optical fiber 216. The single honeycomb shade 213 is mechanically coupled to the top housing assembly 211 adjacent to the top edge 214 thereof. The single honeycomb shade 213 is mechanically coupled to the bottom housing assembly 212 adjacent to the bottom edge 215 thereof. The conductive wire 216 has a first end and a second end and extends from the top housing assembly 211 down to the bottom housing assembly 212 and from the bottom housing 212 to the top housing assembly 211. The optical fiber 216 makes a plurality of round-trips each of which extends from the top housing assembly 211 down through the single honeycomb shade 213 to the bottom housing assembly 212 and from the bottom housing assembly 212 up through the single honeycomb shade 213 to the top housing assembly 211.

Figure 8:
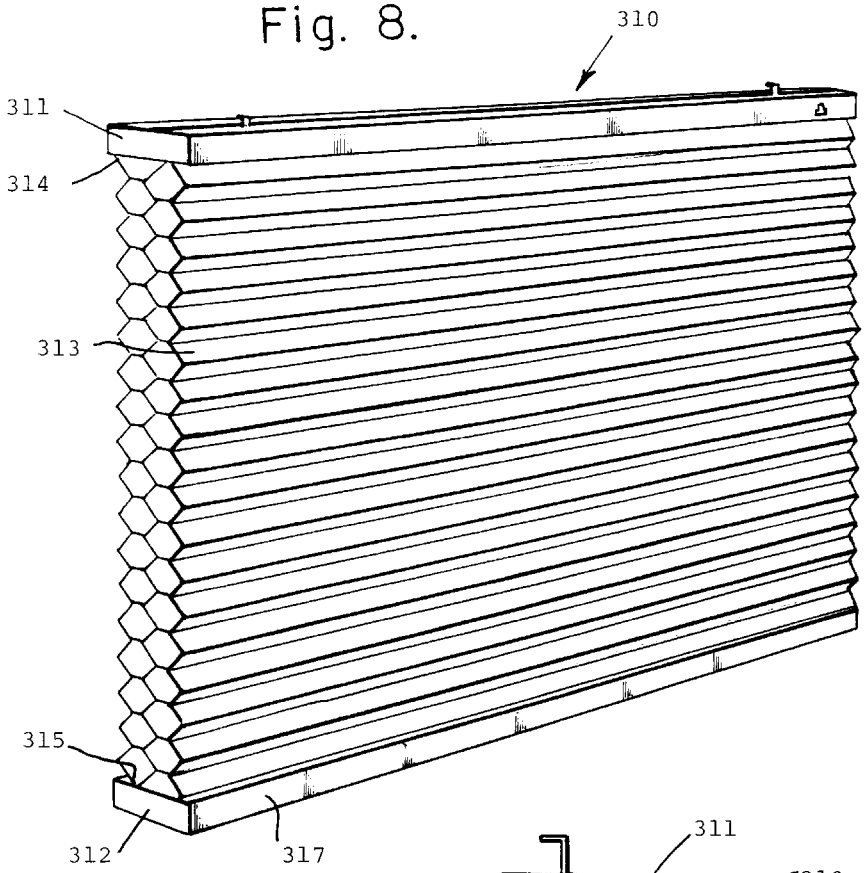
FIG. 8 is a perspective drawing of a combined alarm system and shade assembly which includes a top housing assembly, a bottom housing assembly, a double honeycomb shade, four magnetic reed relay switches, a cord lock, two top bracket assemblies, two bottom bracket assemblies, four magnets and a conductive wire.
Figure 8:
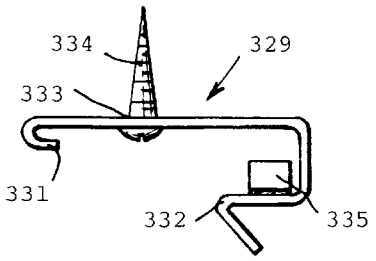
Figure 9:
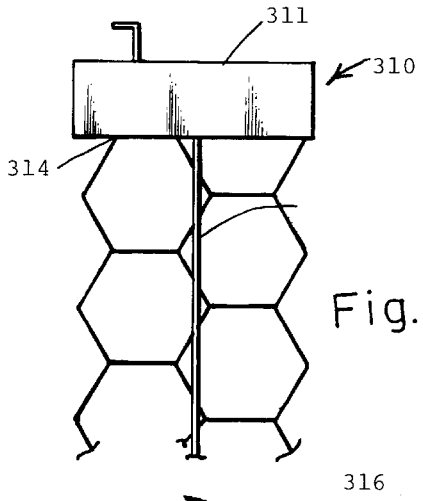
FIG. 9 is a side elevational view of one of the top and bottom bracket assemblies and one of the four magnets of the combined alarm system and shade assembly of FIG. 8.
Figure 10:
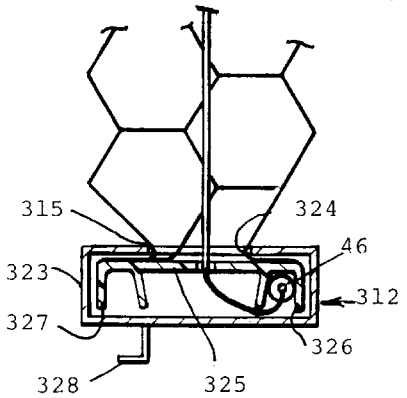
FIG. 10 is a side elevational view in partial cross-section of the combined alarm system and shade assembly of FIG. 8.

Referring to FIG. 8 in conjunction with FIG. 9 and FIG. 10 a combined alarm system and shade assembly 310 includes a top housing assembly 311, a bottom housing assembly 312, a double honeycomb shade 313 having a top edge 314 and a bottom edge 315, a continuous length of conductive wire 316, the first magnetic reed relay switch 40 and the second magnetic reed relay switch 46. U.S. Pat. No. 4,582,109, U.S. Pat. No. 4,677,013 and U.S. Pat. No. 4,861,404 teach single honeycomb structures which may be used to make the double honeycomb shade 313. The top housing assembly 311 includes an elongated, hollow rectangular member with a slot extending lengthwise along the bottom surface thereof, an elongated rail with a first channel and a second channel each of which extends lengthwise along the top inner surface thereof and two L-shaped flanges each of which is mechanically coupled to the elongated, hollow rectangular member and disposed on the top outer surface thereof. One of the first magnetic reed relay switches is disposed in the first channel of the elongated rail at each end thereof. The double honeycomb shade 313 is mechanically coupled to the elongated rail adjacent to the first end thereof. The elongated rail is slidably coupled to the elongated, hollow rectangular member 317 so that the double honeycomb shade 313 extends through the slot of the elongated, hollow rectangular member. The bottom housing assembly 312 includes a elongated, hollow rectangular member 323 with a slot 324 extending lengthwise along the top surface thereof, an elongated rail 325 with a first channel 326 and a second channel 327 each of which extends lengthwise along the bottom inner surface thereof, two L-shaped flanges 328 each of which is mechanically coupled to the elongated, hollow rectangular member 323 and disposed on the bottom outer surface thereof. One of the second magnetic reed relay switches 346 is disposed in the first channel 326 of the elongated rail 325 at each end thereof. The double honeycomb shade 313 is mechanically coupled to the elongated rail 325 adjacent to the second end 315 thereof. The elongated rail 325 is slidably coupled to the elongated, hollow rectangular member 323 so that the double honeycomb shade 313 extends through the slot 324 of the elongated, hollow rectangular member 323. The combined alarm system and shade assembly 310 also includes two top bracket assemblies 329, two bottom bracket assemblies and a cord lock. U.S. Pat. No. 4,982,776 and U.S. Pat. No. 4,913,210 teach cord locks. Each top bracket assembly 329 includes a first J-shaped member 331 with a first crook 332 and a first bore 333, a first mounting screw 334 and a first magnet 335. Each bottom bracket assembly includes a second J-shaped member with a second crook and a second bore, a second mounting screw and a second magnet. U.S. Pat. No. 4,363,459 teaches a bracket which includes a first J-shaped member with a first crook and a first bore and a first mounting screw. The continuous length of conductive wire 316 has a first end and a second end and extends from the top housing assembly 311 down to the bottom housing assembly 312 and from the bottom housing 312 to the top housing assembly 311. The first and second magnetic reed relay switch 40 and 46 electrically couple the severed portions of the continuous length of conductive wire 316 back together in the presence of the first and second magnets 335 and 340. The continuous length of conductive wire 316 makes a plurality of roundtrips each of which extends from the top housing assembly 311 down through the double honeycomb shade 313 to the bottom housing assembly 312 and from the bottom housing assembly 312 up through the double honeycomb shade 313 to the top housing assembly 311.

Referring to FIG. 8 in conjunction with FIG. 1, FIG. 2, FIG. 9 and FIG. 10 the double honeycomb shade 313 is a covering which has a centerline and which is mechanically coupled to the top housing 311 and the bottom rail 312. The conductive wire 316 is disposed along the centerline of the double honeycomb shade 313.

Referring to FIG. 11 in conjunction with FIG. 12 a combined alarm system and shade assembly 410 includes a top housing assembly 411, a bottom housing assembly 412, a double honeycomb shade 413 having a top edge 414 and a bottom edge 415 and an optical fiber 416. The double honeycomb shade 413 is mechanically coupled to the elongated rail adjacent to the first end thereof. The elongated rail is slidably coupled to the elongated, hollow rectangular member 417 so that the double honeycomb shade 413 extends through the slot 418 of the elongated, hollow rectangular member 417. The double honeycomb shade 413 is mechanically coupled to the elongated rail 424 adjacent to the second end 415 thereof. The optical fiber 416 has a first end and a second end and extends from the top housing assembly 411 down to the bottom housing assembly 412 and from the bottom housing 412 to the top housing assembly 411. The optical fiber 416 makes a plurality of round-trips each of which extends from the top housing assembly 411 down through the double honeycomb shade 413 to the bottom housing assembly 412 and from the bottom housing assembly 412 up through the double honeycomb shade 413 to the top housing assembly 411.

Referring to FIG. 11 in conjunction with FIG. 1, FIG. 2 and FIG. 12 the double honeycomb shade 413 is a covering 313 which has a centerline and which is mechanically coupled to the top housing 11 and the bottom rail 12. The optical wire 416 is disposed along the centerline of the double honeycomb shade.

Figure 13:
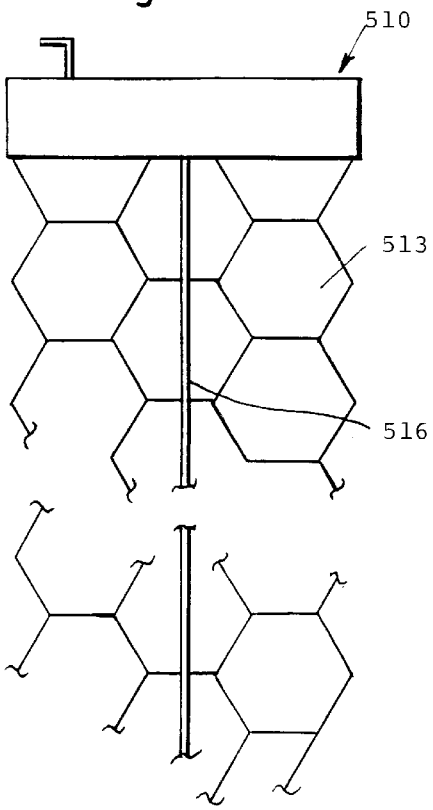
FIG. 13 is a partial side elevational view of a combined alarm system and shade assembly which includes a triple honeycomb shade and an optical fiber.

Referring to FIG. 13 a combined alarm system and shade assembly 510 includes a top housing assembly 511, a bottom housing assembly, a triple honeycomb shade 513 having a top edge 514 and a bottom edge and a conductive wire 516. The triple honeycomb shade 513 is mechanically coupled to the top housing assembly 511 adjacent to the top edge 514 thereof. The triple honeycomb shade 513 is mechanically coupled to the bottom housing assembly adjacent to the second end thereof. The conductive wire 516 has a first end and a second end and extends from the top housing assembly 511 down to the bottom housing assembly and from the bottom housing to the top housing assembly 511. The conductive wire 516 makes a plurality of round-trips each of which extends from the top housing assembly 511 down through the triple honeycomb shade 513 to the bottom housing assembly and from the bottom housing assembly up through the triple honeycomb shade 513 to the top housing assembly 511.

Referring to FIG. 13 in conjunction with FIG. 1 and FIG. 2 the triple honeycomb 513 is a covering which has a centerline and which is mechanically coupled to the top housing 11 and the bottom rail 12. The conductive wire 514 is disposed along the centerline of the triple honeycomb shade 513.

Figure 14:
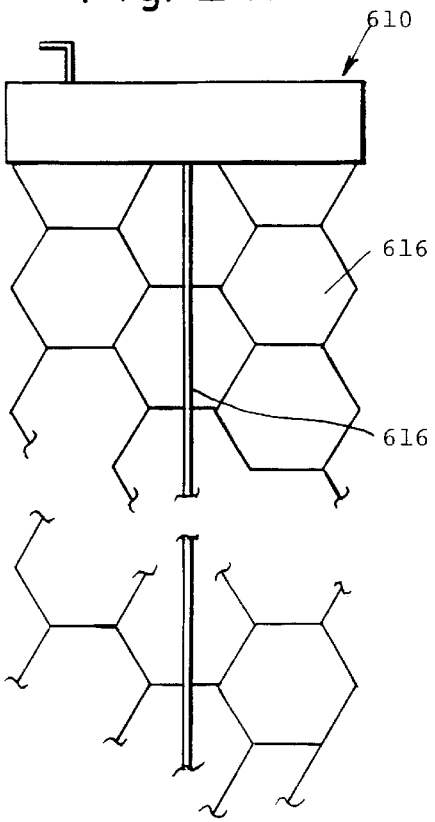
FIG. 14 is a partial side elevational view of a combined alarm system and shade assembly which includes a triple honeycomb shade and an optical fiber.

Referring to FIG. 14 a combined alarm system and shade assembly 610 includes a top housing assembly 611, a bottom housing assembly, a triple honeycomb shade 613 having a top edge 614 and a bottom edge and ao optical fiber 616. The triple honeycomb shade 613 is mechanically coupled to the top housing assembly 611 adjacent to the top edge 614 thereof. The triple honeycomb shade 613 is mechanically coupled to the bottom housing assembly adjacent to the second end thereof. The conductive wire 616 has a first end and a second end and extends from the top housing assembly 611 down to the bottom housing assembly and from the bottom housing to the top housing assembly 611. The optical fiber 616 makes a plurality of round-trips each of which extends from the top housing assembly 611 down through the triple honeycomb shade 613 to the bottom housing assembly and from the bottom housing assembly up through the triple honeycomb shade 613 to the top housing assembly 611.

Referring to FIG. 14 in conjunction with FIG. 1 and FIG. 2 the triple honeycomb 613 is a covering which has a centerline and which is mechanically coupled to the top housing 11 and the bottom rail 12. The conductive wire 614 is disposed along the centerline of the triple honeycomb shade 613.

Figure 15:
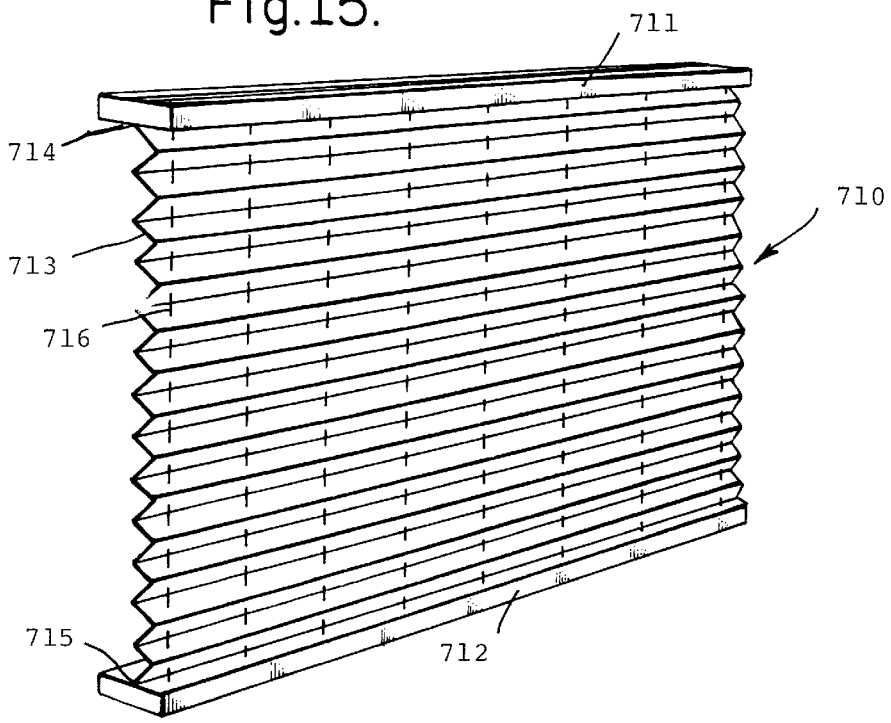
FIG. 15 is a perspective drawing of a combined alarm system and shade assembly which includes a top housing assembly, a bottom housing assembly, a pleated shade, four magnetic reed relay switches, a cord lock, two top bracket assemblies, two bottom bracket assemblies, four magnets and a conductive wire.
Figure 16:
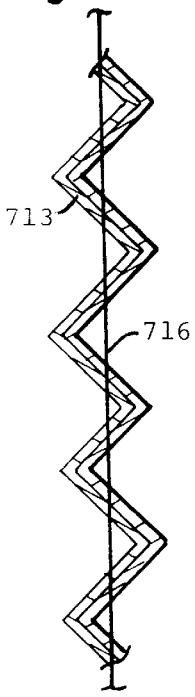
FIG. 16 is a side elevational view in cross-section of the pleated shade of the combined alarm system and shade assembly of FIG. 15 which has a first sheet and a second sheet.

Referring to FIG. 15 in conjunction with FIG. 16 a combined alarm system and shade assembly 710 includes the top housing assembly 711, the bottom housing assembly 712, a pleated shade 713 having a top edge 714 and a bottom edge 715, a conductive wire 716, a first magnetic reed relay switch and a second magnetic reed relay switch. U.S. Pat. No. 4,974,656 teaches a pleated shade which may be used to make the pleated shade 713. The pleated shade 713 is mechanically coupled to the elongated rail 719 adjacent to the first end 714 thereof. The elongated rail 719 is slidably coupled to the elongated, hollow rectangular member 717 so that the pleated shade 713 extends through the slot 718 of the elongated, hollow rectangular member 717. The pleated shade 713 is mechanically coupled to the elongated rail 724 adjacent to the second end 715 thereof. The elongated rail 725 is slidably coupled to the elongated, hollow rectangular member 723 so that the pleated shade 713 extends through the slot 724 of the elongated, hollow rectangular member 723. The combined alarm system and shade assembly 710 also includes the two top bracket assemblies 729, the two bottom bracket assemblies 730 and a cord lock 731. U.S. Pat. No. 4,913,210 teaches a cord lock for a pleated shade. The conductive wire 716 makes a plurality of round-trips each of which extends from the top housing assembly 711 down through the pleated shade 713 to the bottom housing assembly 712 and from the bottom housing assembly 712 up through the pleated shade 713 to the housing assembly 711.

Figure 17:
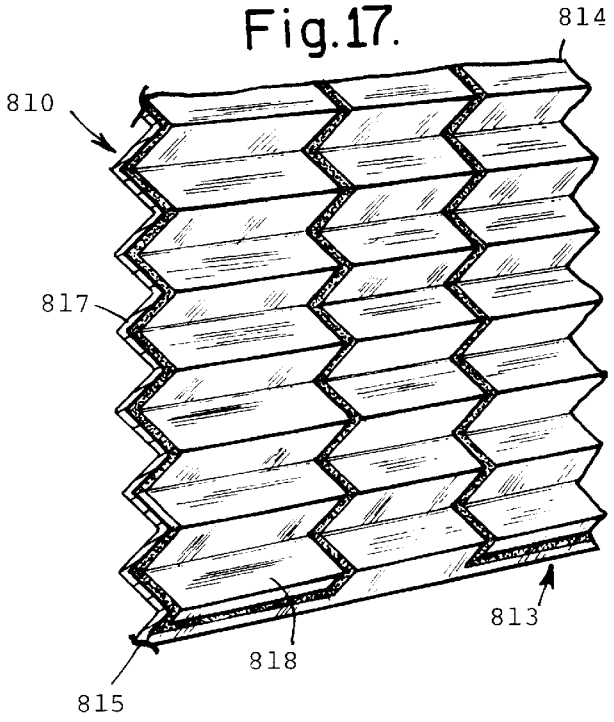
FIG. 17 is a perspective drawing of a first sheet and a conductive path of a pleated shade for use in a combined alarm system and shade assembly including a top housing assembly, a bottom housing assembly, four magnetic reed relay switches, a cord lock, two top bracket assemblies, two bottom bracket assemblies, four magnets and a conductive wire.
Figure 18:
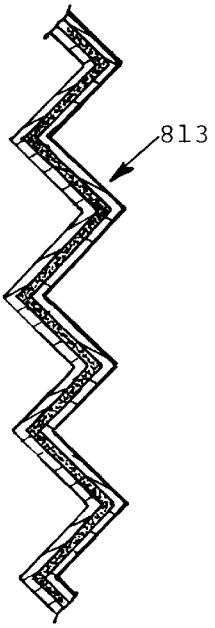
FIG. 18 is a side elevational view in cross-section of the second pleated shade of FIG. 17 which includes the first sheet, the conductive path and a second pleated sheet.

Referring to FIG. 17 in conjunction with FIG. 18 a combined alarm system and shade assembly 810 includes the third top housing assembly 811, the third bottom housing assembly 812, a pleated shade 813 having a top edge 814 and a bottom edge 815, a conductive path 816, the first magnetic reed relay switch 40 and the second magnetic reed relay switch 46. U.S. Pat. No. 4,862,941 teach a pleated shade which may be used to make the second pleated shade 813. The pleated shade 813 includes a first pleated sheet 817 and a second pleated sheet 818 which are spaced apart in substantially parallel array by the top and bottom housing assemblies 811 and 812. The conductive path 816 is formed by applying a layer of flexible and electrically conductive coating composition to the first pleated sheet. U.S. Pat. No. 4,999,608 teaches the use of an elongated path of flexible and electrically conductive coating composition which is applied to a screen mesh in a predetermined and non-overlapping pattern. The pleated shade 813 is mechanically coupled to the elongated rail 819 adjacent to the first end 814 thereof. The elongated rail 819 is slidably coupled to the elongated, hollow rectangular member 817 so that the pleated shade 813 extends through the slot 818 of the elongated, hollow rectangular member 817. The pleated shade 813 is mechanically coupled to the elongated rail 824 adjacent to the second end 815 thereof. The elongated rail 825 is slidably coupled to the elongated, hollow rectangular member 823 so that the pleated shade 813 extends through the slot 824 of the elongated, hollow rectangular member 823. The combined alarm system and shade assembly 810 also includes the two top bracket assemblies 829, the two bottom bracket assemblies 830 and a cord lock 631. The conductive path 816 makes a plurality of roundtrips each of which extends from the top housing assembly 811 down through the pleated shade 813 to the bottom housing assembly 812 and from the bottom housing assembly 812 up through the pleated shade 813 to the top housing assembly 811.

Figure 19:
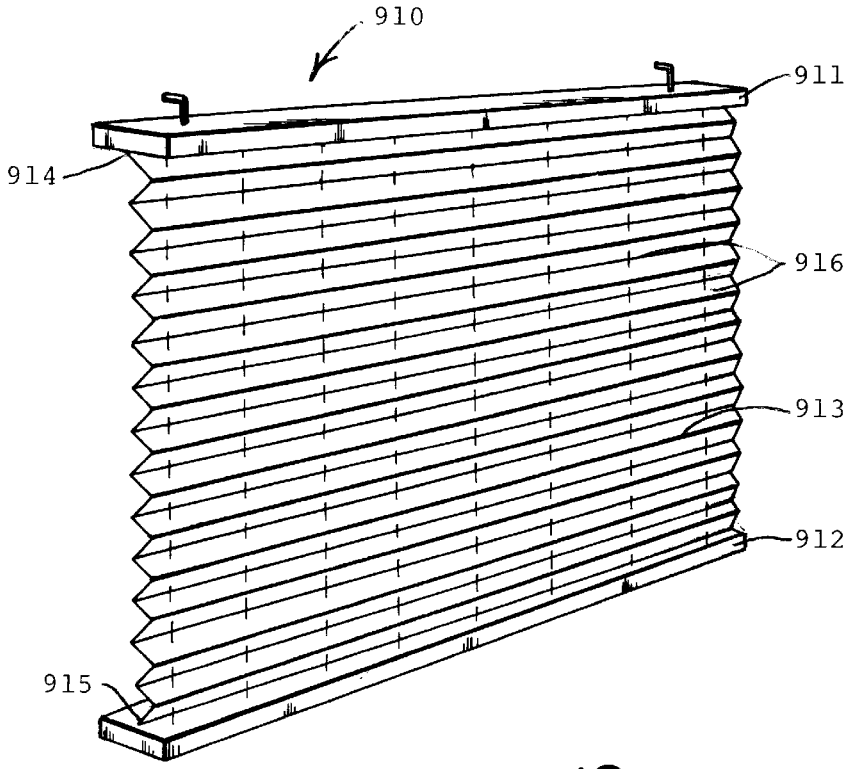
FIG. 19 is a perspective drawing of a combined alarm system and shade assembly which includes a pleated shade and an optical fiber.
Figure 20:
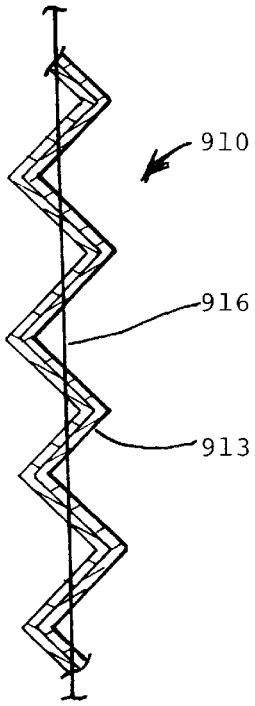
FIG. 20 is a partial side elevational view in cross-section of the combined alarm system and shade assembly of FIG. 19.

Referring to FIG. 19 in conjunction with FIG. 20 a combined alarm system and shade assembly 910 includes the top housing assembly 911, the bottom housing assembly 912, a pleated shade 913 having a top edge 914 and a bottom edge 915 and an optical fiber 916. The pleated shade 913 is mechanically coupled to the elongated rail 919 adjacent to the first end 914 thereof. The elongated rail 919 is slidably coupled to the elongated, hollow rectangular member 917 so that the pleated shade 913 extends through the slot 918 of the elongated, hollow rectangular member 917. The pleated shade 913 is mechanically coupled to the elongated rail 924 adjacent to the second end 915 thereof. The elongated rail 925 is slidably coupled to the elongated, hollow rectangular member 923 so that the pleated shade 913 extends through the slot 924 of the elongated, hollow rectangular member 923. The combined alarm system and shade assembly 910 also includes the two top bracket assemblies 929, the two bottom bracket assemblies 930 and a cord lock 931. The optical fiber 916 makes a plurality of round-trips each of which extends from the top housing assembly 911 down through the pleated shade 913 to the bottom housing assembly 912 and from the bottom housing assembly 912 up through the pleated shade 913 to the housing assembly 911.

Figure 21:
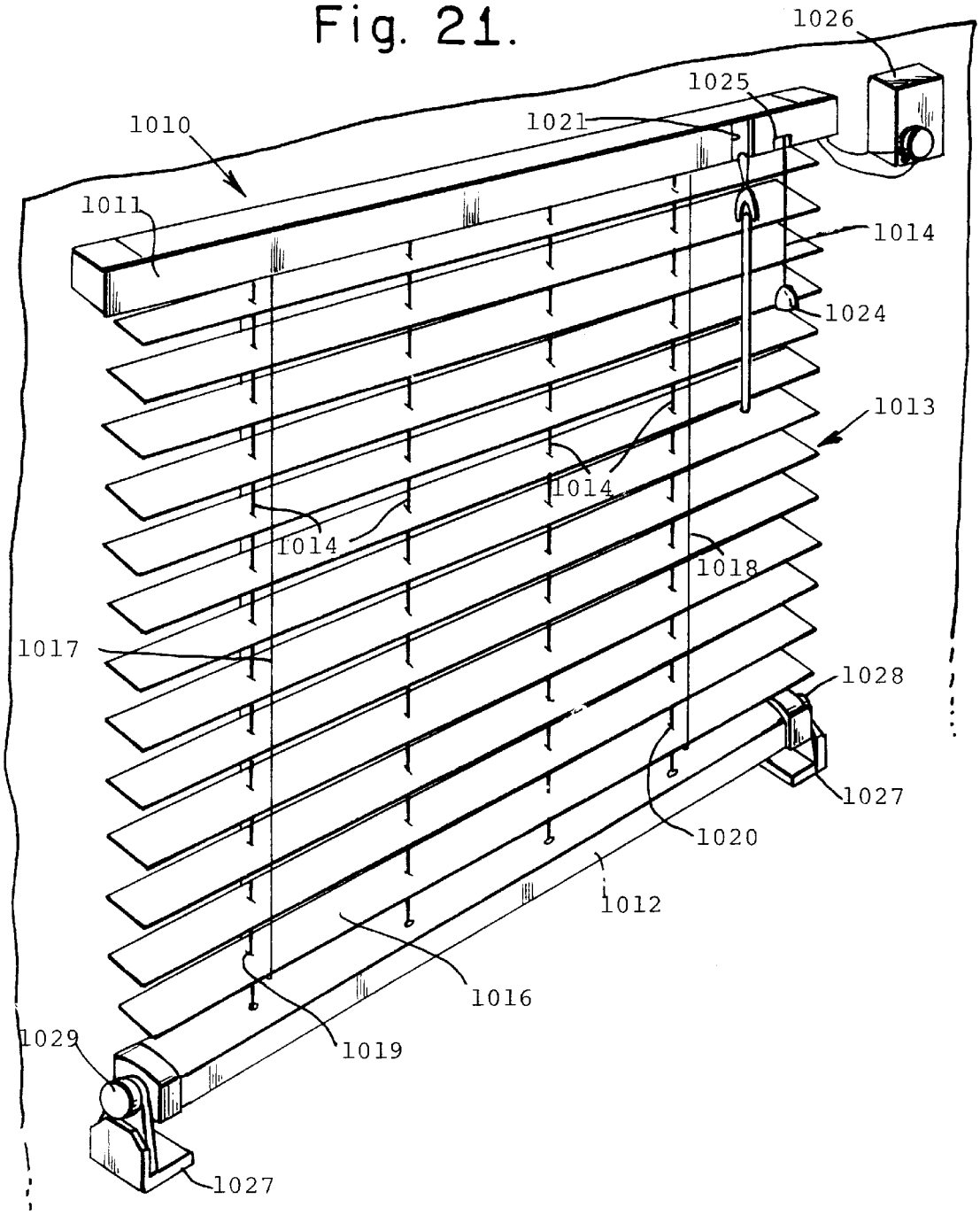
FIG. 21 is a perspective drawing of a combined alarm system and blind assembly which includes a plurality of slats, a top housing assembly including two resiliently biased alarm switches, a bottom housing rail including a resiliently biased reed relay switch and a conductive wire.
Figure 22:
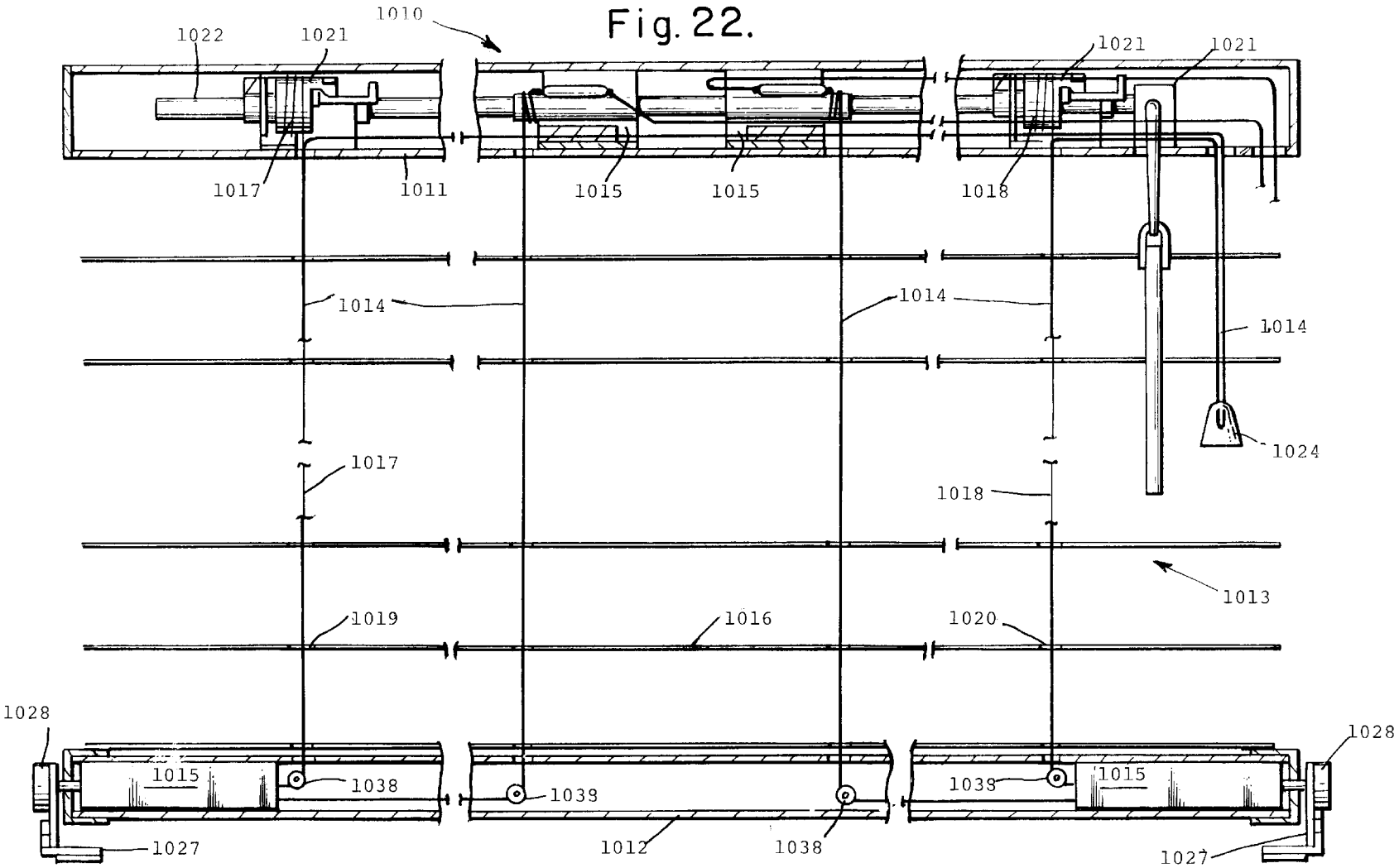
FIG. 22 is an elevational view in cross-section of the combined alarm system and blind assembly of FIG. 21.

Referring to FIG. 21 in conjunction with FIG. 22 a combined alarm system and window covering assembly 1010 includes a top housing 1011, a bottom rail 1012 having two ends, a covering 1013, a conductive wire 1014, two of the resiliently biased reed relay switches 3515 and two rotatable, resiliently biased reed relay switches 1015. The covering 1013 is mechanically coupled to the top housing 1011 and the bottom rail 1012. The conductive wire 1014 extends from the top housing 1011 down to the bottom rail 1012 and up from the bottom rail 1012 to the top housing 1011. The conductive wire 1014 functions as a pull cord for raising and lowering the bottom rail 1012.

Still referring to FIG. 21 in conjunction with FIG. 22 the covering 1013 includes a plurality of individual slats 1016, a first string ladder support system 1017 and a second string ladder support system 1018. Each slat 1016 has a first slot 1019 and a second slot 1020, which is spaced apart from the first slot 1019. The first string ladder support system 1017 has a front vertical ladder string and a back vertical ladder string with short support strings fastened between the front and back vertical ladder strings. The first string ladder support system 1017 is mechanically coupled to the top housing 1011 and the bottom rail 1012. Each short support string of the first string ladder support system 1017 supports one of the slats 1016 contiguous to the first slot 1018 thereof. The second string ladder support system 1018 has a front vertical ladder string and a back vertical ladder string with short support strings fastened between the front and back vertical ladder strings. The second string ladder support system 1018 is mechanically coupled to the top housing 1011 and the bottom rail 1012. Each short support string of the second string ladder support system 1018 supports one of the slats 1016 contiguous to the second slot 1020 thereof. The conductive wire 1014 extends from the top housing 1011 down through each of the first slots 1018 of the slats 1016 to the bottom rail 1012 and from the bottom rail 1012 through each of the second slots 1020 of the slats 1016 to the top housing 1011. The top housing 1011 has a tilting mechanism 1021, a tilt rod 1022 and a pull string assembly 1023 disposed therein. The tilt rod 1022 is mechanically coupled to the tilting mechanism 3121 and is fixedly coupled to the first and second string ladder support systems 1017 and 1018. The pull string assembly 1023 includes a pull tab 1024, a conductive wire 1014 and a cord lock unit 1025. The cord 1014 is mechanically coupled to the pull tab 1024. The cord lock unit 1025 is disposed in the top housing 1011 and mechanically coupled thereto. An alarm device 1026 has a first input terminal and a second input terminal. The first and second ends of the conductive wire 1014 are electrically coupled to the first and second input terminals, respectively, of the alarm device 1026.

Referring to FIG. 21 in conjunction with FIG. 15, FIG. 16 and FIG. 22 the covering 1013 is a single honeycomb shade which has a centerline and which is mechanically coupled to the top housing 1011 and the bottom rail 1012. A conductive wire is disposed along the centerline of the single honeycomb shade.

Referring to FIG. 21 in conjunction with FIG. 19, FIG. 20 and FIG. 22 the combined alarm system and shade assembly 1010 includes the top housing 1011, the bottom rail 1012 and the covering 1013 is a pleated shade which has a centerline and which is mechanically coupled to the top housing 1011 and the bottom rail 1012. An optical fiber is disposed along the centerline of the pleated shade.

Figure 23:
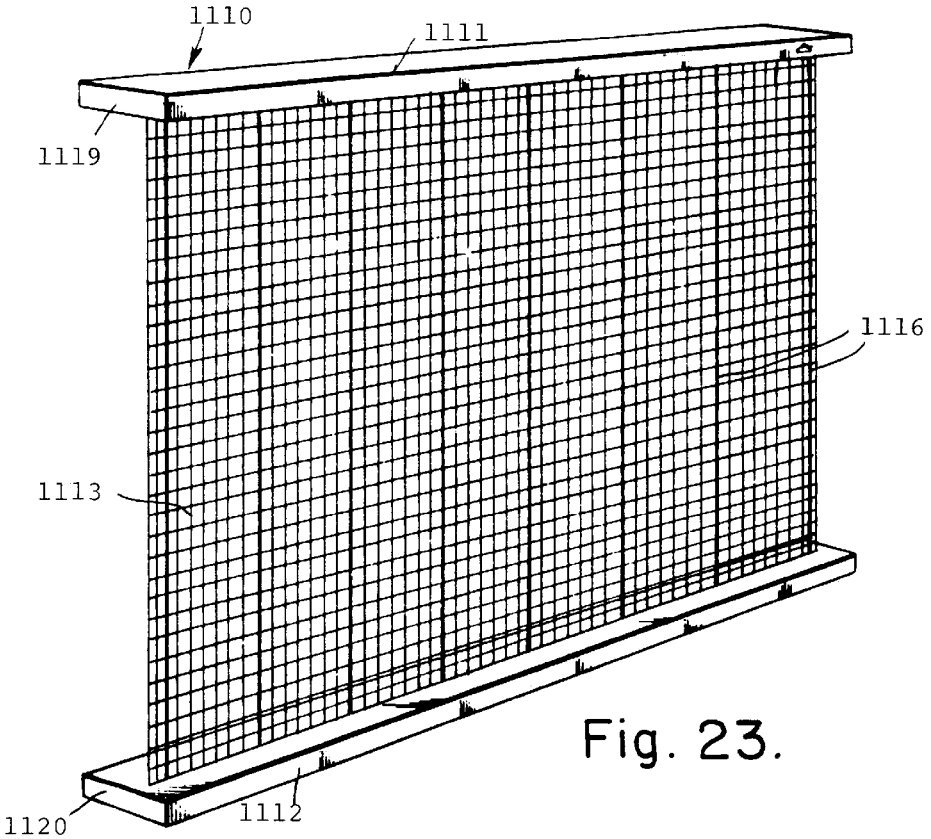
FIG. 23 is a perspective drawing of a combined alarm system and screen assembly which includes a top housing assembly, a bottom housing assembly, a screen mesh and a conductive wire.
Figure 24:
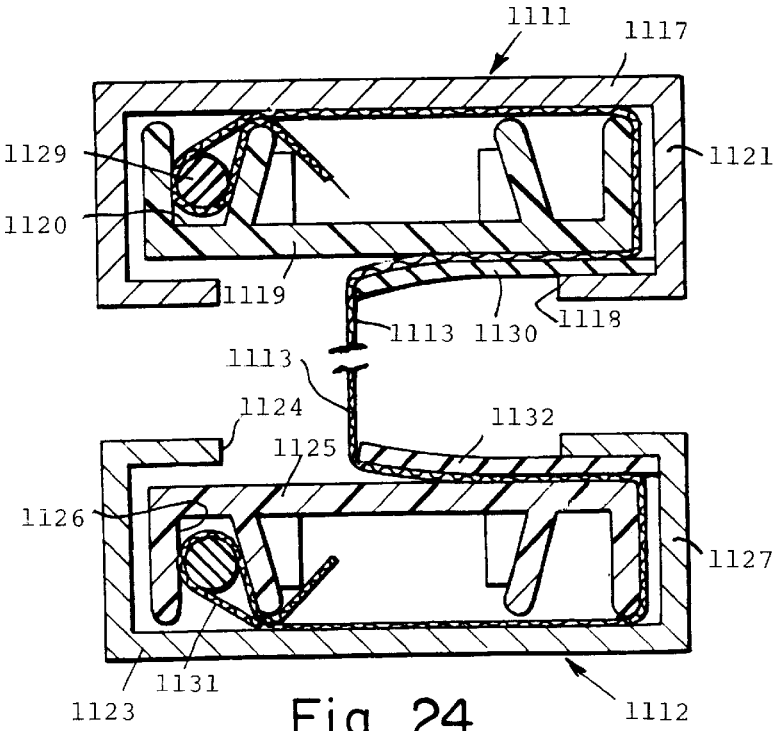
FIG. 24 is a partial side elevational view in cross-section of the bottom bracket assemblies of the combined alarm system and screen assembly of FIG. 23.

Referring to FIG. 23 in conjunction with FIG. 24 a combined alarm system and screen assembly 1110 includes a top housing assembly 1111, a bottom housing assembly 1112, a screen mesh 1113 having a top edge and a bottom edge , a conductive wire 1116, the first magnetic reed relay switch and the second magnetic reed relay switch. U.S. Pat. No. 4,146,293 teaches a combined alarm system and screen assembly includes a screen mesh and a conductive wire which may be sewn, glued or interwoven onto the screen mesh. The top housing assembly 1111 includes an elongated, hollow rectangular member with a slot extending lengthwise along the top surface thereof and an elongated rail 1119 with a first channel 1120 and a second channel each of which extends lengthwise along the bottom inner surface thereof. Each of the two L-shaped flanges may be mechanically coupled to the first elongated, hollow rectangular member and disposed on the bottom outer surface thereof. The screen mesh 1113 is mechanically coupled to the first elongated rail adjacent to the first end thereof. The first elongated rail is slidably coupled to the first elongated, hollow rectangular member so that the screen mesh 1113 extends through the slot of the first elongated, hollow rectangular member . The top housing assembly 1111 also includes a spline 1129 and an elongated elastic member. The spline is disposed in the first channel of the elongated rail and secures the screen mesh 1113 within the top housing assembly 1111. The elongated elastic member is disposed along with the screen mesh 1113 between the elongated, hollow rectangular member and the second channel of the first elongated rail 1119 and functions as a tensioning mechanism for taking up any slack in the screen mesh 1113. One of the first magnetic reed relay switches is disposed in the first channel of the elongated rail at each end thereof. The bottom housing assembly 1112 includes an elongated, hollow rectangular member with a slot extending lengthwise along the top surface thereof and a second elongated rail with a first channel and a second channel each of which extends lengthwise along the bottom inner surface thereof. Each of the two L-shaped flanges may be mechanically coupled to the elongated, hollow rectangular member and disposed on the bottom outer surface thereof. One of the second magnetic reed relay switches is disposed in the first channel of the second elongated rail at each end thereof. The screen mesh 1113 is mechanically coupled to the elongated rail adjacent to the second end thereof. The elongated rail is slidably coupled to the elongated, hollow rectangular member so that the screen mesh 1113 extends through the slot of the elongated, hollow rectangular member. The bottom housing assembly 1112 also includes a spline and an elongated elastic member. The spline is disposed in the first channel of the elongated rail and secures the screen mesh 1113 within the bottom housing assembly 1112. The elongated elastic member is disposed along with the screen mesh 1113 between the elongated, hollow rectangular member and the second channel of the elongated rail 1125 and functions as a tensioning mechanism for taking up any slack in the screen mesh 1113. The combined alarm system and shade assembly 1110 may also include the two top bracket assemblies, the two bottom bracket assemblies and a cord lock. Each top bracket assembly includes a first J-shaped member with a first crook and a first bore, a first mounting screw and a first magnet. Each bottom bracket assembly includes a second J-shaped member with a second crook and a second bore, a second mounting screw 1139 and a second magnet. The conductive wire 1116 has a first end and a second end and extends from the top housing assembly 1111 down to the bottom housing assembly 1112 and from the bottom housing 1112 to the top housing assembly 1111. The first and second magnetic reed relay switches electrically couple the severed portions of the conductive wire 1116 back together in the presence of the first and second magnets. The conductive wire 1116 makes a plurality of round-trips each of which extends from the top housing assembly 1111 down through the screen mesh 1113 to the bottom housing assembly 1112 and from the bottom housing assembly 1112 up through the screen mesh 813 to the top housing assembly 1111. The screen mesh 1113 is formed from a sheet of screen material and has marginal edge portions which are adapted to be secured to a frame. A single integral length of conductive wire 1116 has a first plurality of parallel segments and a second plurality of parallel segments. The first plurality of parallel segments has been spaced apart and interwoven into the screen mesh 1113. The second plurality of parallel segments is contiguous at each end to one of the first plurality of parallel segments and has not been interwoven into the screen mesh 1113. The second plurality of parallel segments are disposed perpendicular to the first plurality of parallel segments. None of the first and second pluralities of parallel segments are spliced together.

Figure 25:
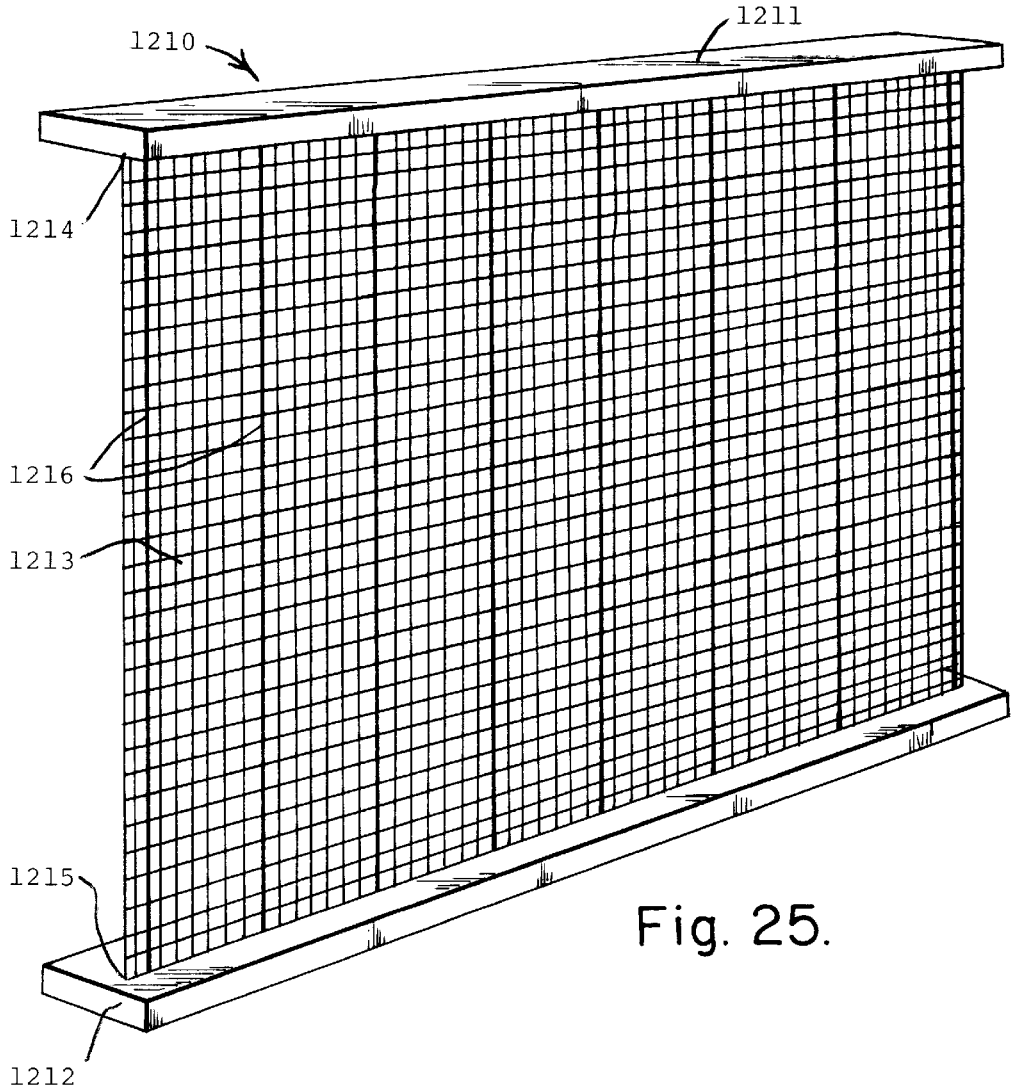
FIG. 25 is a perspective drawing of a combined alarm system and screen assembly which includes a top housing assembly, a bottom housing assembly, a screen mesh and an optica1 fiber.
Figure 26:
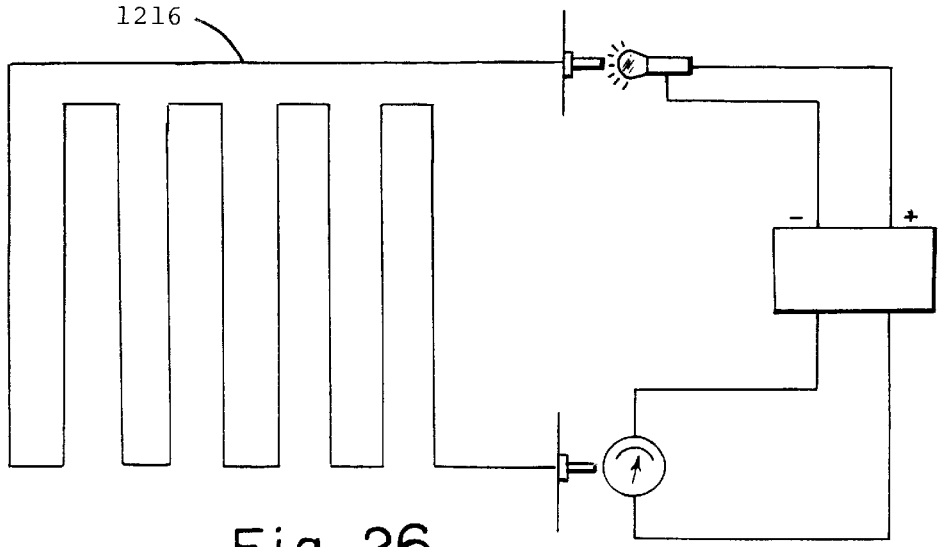
FIG. 26 is a schematic diagram of the optical fiber of the combined alarm system and screen assembly of FIG. 25.
Figure 27:
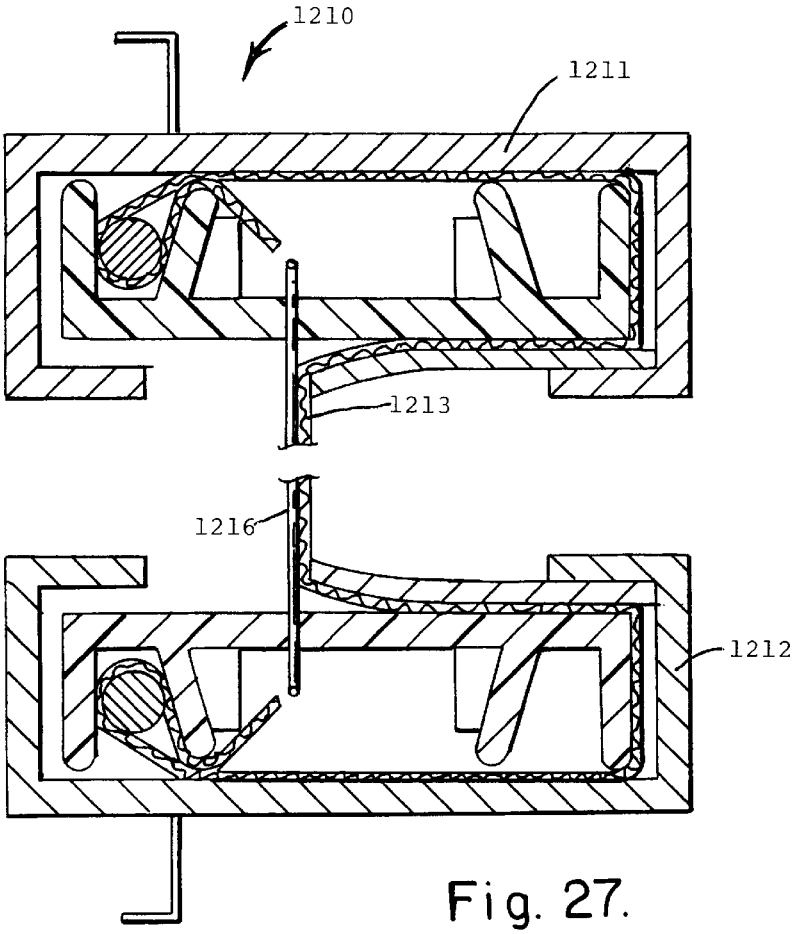
FIG. 27 is a partial side elevational view in cross-section of the top and bottom housing assemblies of the combined alarm system and screen assembly of FIG. 25.

Referring to FIG. 25 in conjunction with FIG. 26 and FIG. 27 a combined alarm system and screen assembly 1210 includes a top housing assembly 1211, a bottom housing assembly 1212, a screen mesh 1213 having a top edge 1214 and a bottom edge 1215, an optical fiber 1216 which may be sewn, glued or interwoven onto the screen mesh. The top housing assembly 1211 includes an elongated, hollow rectangular member 1217 with a slot 1218 extending lengthwise along the top surface thereof and an elongated rail 1219 with a first channel 1220 and a second channel 1221 each of which extends lengthwise along the bottom inner surface thereof. Each of the two L-shaped flanges 1222 may be mechanically coupled to the first elongated, hollow rectangular member 517 and disposed on the bottom outer surface thereof. The screen mesh 1213 is mechanically coupled to the first elongated rail 1219 adjacent to the first end 1214 thereof. The first elongated rail 1219 is slidably coupled to the first elongated, hollow rectangular member 1217 so that the screen mesh 813 extends through the slot 1218 of the first elongated, hollow rectangular member 1217. The top housing assembly 1211 also includes a spline 1229 and an elongated elastic member 1230. The spline 1229 is disposed in the first channel 1220 of the elongated rail 1219 and secures the screen mesh 813 within the top housing assembly 1211. The elongated elastic member 830 is disposed along with the screen mesh 813 between the elongated, hollow rectangular member 1217 and the second channel 1221 of the first elongated rail 1219 and functions as a tensioning mechanism for taking up any slack in the screen mesh 813. The bottom housing assembly 1212 includes an elongated, hollow rectangular member 1223 with a slot 1224 extending lengthwise along the top surface thereof and a second elongated rail 1225 with a first channel 1226 and a second channel 1227 each of which extends lengthwise along the bottom inner surface thereof. Each of the two L-shaped flanges 1228 may be mechanically coupled to the elongated, hollow rectangular member 1223 and disposed on the bottom outer surface thereof. The screen mesh 1213 is mechanically coupled to the elongated rail 1224 adjacent to the second end 1215 thereof. The elongated rail 1225 is slidably coupled to the elongated, hollow rectangular member 1223 so that the screen mesh 1213 extends through the slot 1224 of the elongated, hollow rectangular member 1223. The bottom housing assembly 1212 also includes a spline 1231 and an elongated elastic member 1232. The spline 1231 is disposed in the first channel 1226 of the elongated rail 1225 and secures the screen mesh 1213 within the bottom housing assembly 1212. The elongated elastic member 1232 is disposed along with the screen mesh 1213 between the elongated, hollow rectangular member 1223 and the second channel 1227 of the elongated rail 1225 and functions as a tensioning mechanism for taking up any slack in the screen mesh 1213. The combined alarm system and screen assembly 1010 may also include the two top bracket assemblies 1229, the two bottom bracket assemblies 1230 and a cord lock 1231. Each top bracket assembly 1229 includes a first J-shaped member 1231 with a first crook 1232 and a first bore 1233, a first mounting screw 1234 and a first magnet 1235. Each bottom bracket assembly 1230 includes a second J-shaped member 1236 with a second crook 1237 and a second bore 1238, a second mounting screw 1239 and a second magnet 1240. The optical fiber 1216 has a first end and a second end and extends from the top housing assembly 1211 down to the bottom housing assembly 1212 and from the bottom housing 1212 to the top housing assembly 1211. An optical reed relay-type switch 1243 electrically couples the severed portions of the optical fiber 1216 back together in the presence of the first and second magnets 1235 and 1240. The optical fiber 1216 makes a plurality of round-trips each of which extends from the top housing assembly 1211 down through the screen mesh 1213 to the bottom housing assembly 1212 and from the bottom housing assembly 1212 up through the screen mesh 1213 to the top housing assembly 1211. The screen mesh 1213 is formed from a sheet of screen material and has marginal edge portions which are adapted to be secured to a frame. The optical fiber 1216 has a first plurality of parallel segments and a second plurality of parallel segments. The first plurality of parallel segments has been spaced apart and interwoven into the screen mesh 1213. The second plurality of parallel segments is contiguous at each end to one of the first plurality of parallel segments and has not been interwoven into the screen mesh 1213. The second plurality of parallel segments are disposed perpendicular to the first plurality of parallel segments.

Figure 28:
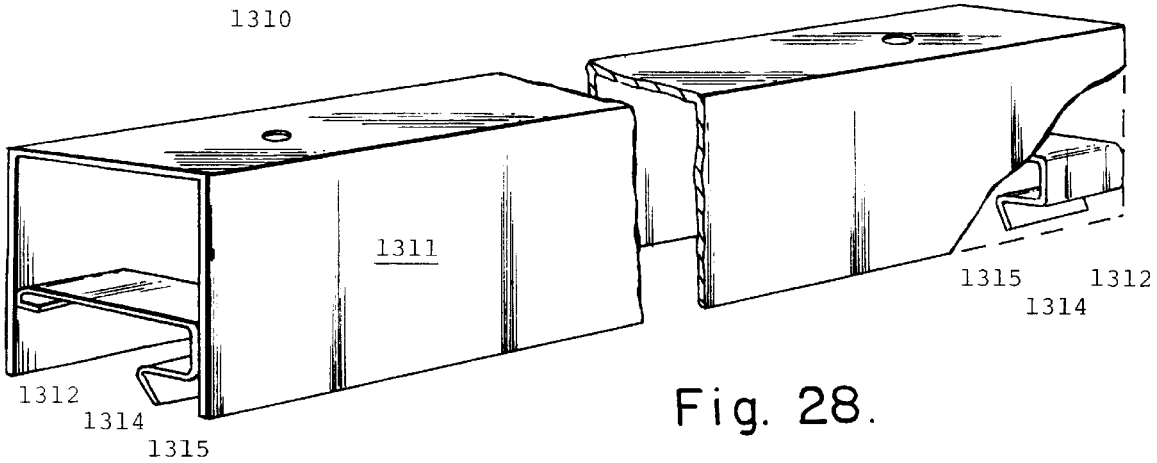
FIG. 28 is a perspective drawing of a top bracket assembly for use with the combined alarm system and screen assembly of FIG. 25.
Figure 29:
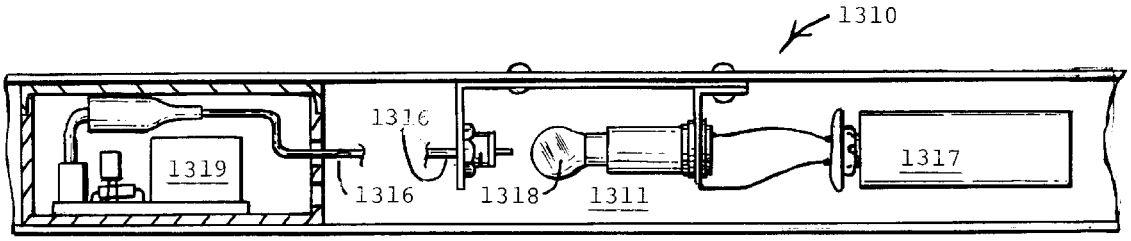
FIG. 29 is a partial side elevational view in cross-section of the top bracket assembly of FIG. 28 showing an optical fiber relay including a battery and a relay switch.
Figure 30:
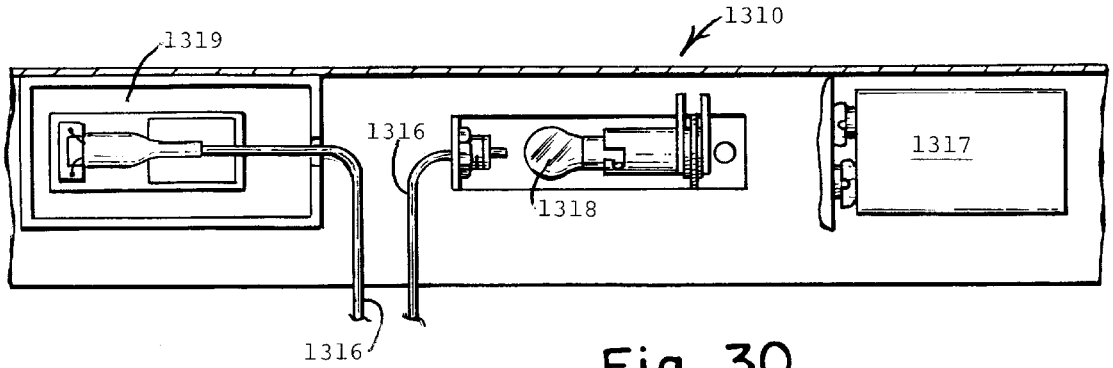
FIG. 30 is a partial bottom plan view of the top bracket assembly of FIG. 27 showing the optical fiber relay of FIG. 28

Referring to FIG. 28 in conjunction with FIG. 29 and FIG. 30 a combined alarm system and screen assembly 1310 includes a top housing assembly 1311 which includes an inverted U-shaped railing 1312 and a top bracket assembly 1313 at each end. Each top bracket assembly 1313 includes a J-shaped member 1314 with a crook 1315. The top housing assembly 1311 may also include a alarm circuit, a smoke detector, a solar battery charging system and an optical relay system 1316 which includes an optical fiber, a battery 1317 and a light 1318 and an optical relay switch 1319.

Figure 31:
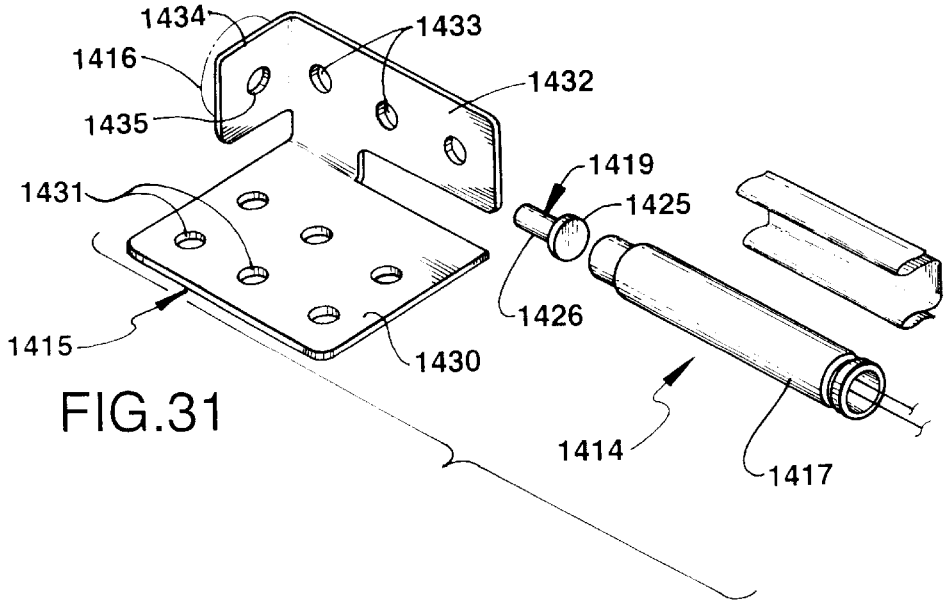
FIG. 31 is a schematic exploded perspective view of a magnet holding and bottom rail bracket having a magnet and a resiliently biased reed relay switch according to the second embodiment.
Figure 32:
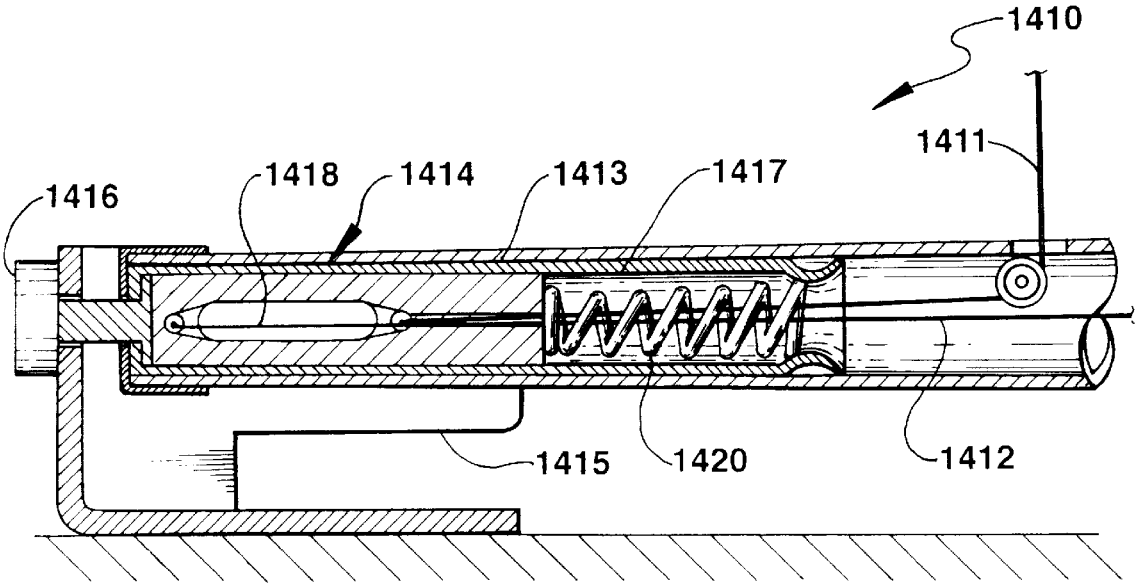
FIG. 32 is an enlarged, partial elevational view in cross-section of a combined alarm system and blind assembly which includes a conductive wire, a bottom rail having the resiliently biased reed relay switch and the magnet holding and bottom rail bracket of FIG. 31.

Referring to FIG. 31 in conjunction with FIG. 32 a combined alarm system and blind assembly 1410 includes a conductive wire 1411, a pull cord 1412, an alarm element, a bottom rail 1413 having a resiliently biased reed relay switch 1414 and a magnet holding and bottom rail bracket 1415 which has a magnet 1416. The resiliently biased reed relay switch 1414 includes a tube 1417, an encapsulated reed relay switch 1418, a cap 1419 and a spring 1420. The tube 1417 has a first end 1421 and a second end 1422 which is crimped. The tube 1417 is mechanically coupled to one of the ends of bottom rail 1413. The encapsulated reed relay switch 1418 is fixedly coupled to the pull cord 1412 and is slidably disposed within the tube 1417. The encapsulated reed relay switch 1418 has a first end 1423 with a first conductive lead and a second end 1424 with a second conductive lead. Both of the first and second conductive leads are coupled to the alarm element. The cap 1419 has a disc-shaped portion 1425 which is fixedly coupled to the second end 1424 of the encapsulated reed relay switch 1418 and a rod-shaped portion 1426. The spring 1420 has a first end 1427 and a second end 1428. The spring 1420 is disposed in the tube 1417 so that the first end 1427 of the spring 1420 is adjacent to the second end 1422 of the tube 1417 and the second end 1428 of the spring 1420 is adjacent to the first end 1423 of the encapsulated reed relay switch 1418. The resiliently biased reed relay switch 1414 resiliently couples the pull cord 1412 to the bottom rail 1413. The magnet holding and bottom rail bracket 1415 is a bracket 1429 which has a base 1430 having a plurality of holes 1431, a support 1432 having a plurality of holes 1433 and a flange 1434 having a hole 1435. The base 1430, the support 1432 and the flange 1434 are orthogonally disposed to each other. The support 1432 is fixedly coupled to the base 1430. The flange 1434 is fixedly coupled to the support 1432. The magnet 1416 is a disc-shaped and has a hole 1436 therein. The hole 1436 in the magnet 1416 is aligned with the hole 1435 in the flange 1434. The magnet 1416 is fixedly coupled to the flange 1434. The rod-shaped portion 1426 engages both the hole 1435 in the flange 1434 and the hole 1436 in the magnet 1416. The conductive wire 1411 may be disposed either within the pull cord 1412 or disposed separate from the pull cord 1412.

U.S. Pat. No. 4,839,632 teaches a combined alarm system and screen assembly which includes a top housing assembly, a bottom housing assembly, a screen mesh and a circuit including a conductive wire which is coupled in the screen mesh. The bottom housing assembly includes a bottom rail, two end piece assemblies, two bottom brackets and two mounting assemblies. Each end piece assembly includes a circuit closing mechanism, a spring and a reed-relay switch. Each circuit closing mechanism is disposed at one corner of the bottom housing assembly and includes two mounting assembly, Each bottom bracket includes a magnet. The circuit closing mechanism acts between the bottom bracket there and the adjacent end piece assembly to close the circuit of the alarm device through the conductive wire in the screen mesh only when both end piece assemblies are held by both of the bottom brackets. The combined alarm system and screen assembly 1410 is easier to open by pulling the pull cord 1412 during an emergency than the combined alarm system and screen assembly of U.S. Pat. No. 4,839,632.

Figure 33:
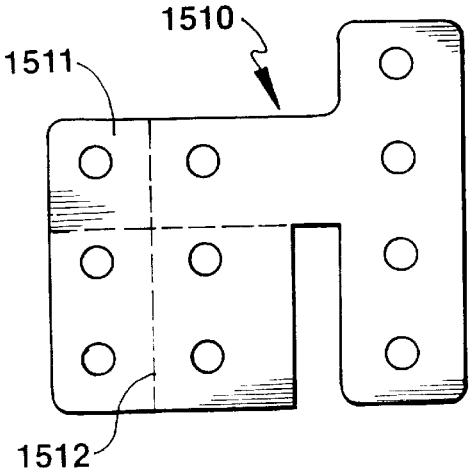
FIG. 33 is a top plan view of a universal plate which may be formed into the magnet holding and bottom rail bracket of different sizes of FIG. 31 in order to fit in window frames of different sizes.

Referring to FIG. 33 in conjunction with FIG. 31 a universal plate 1510 has a face 1511 with a plurality of scored lines 1512. By either bending or cutting along one of these scored lines 1512 a magnet holding and bottom rail bracket 1513 of different sizes is formed in order to fit in window frames of different sizes.

Figure 34:
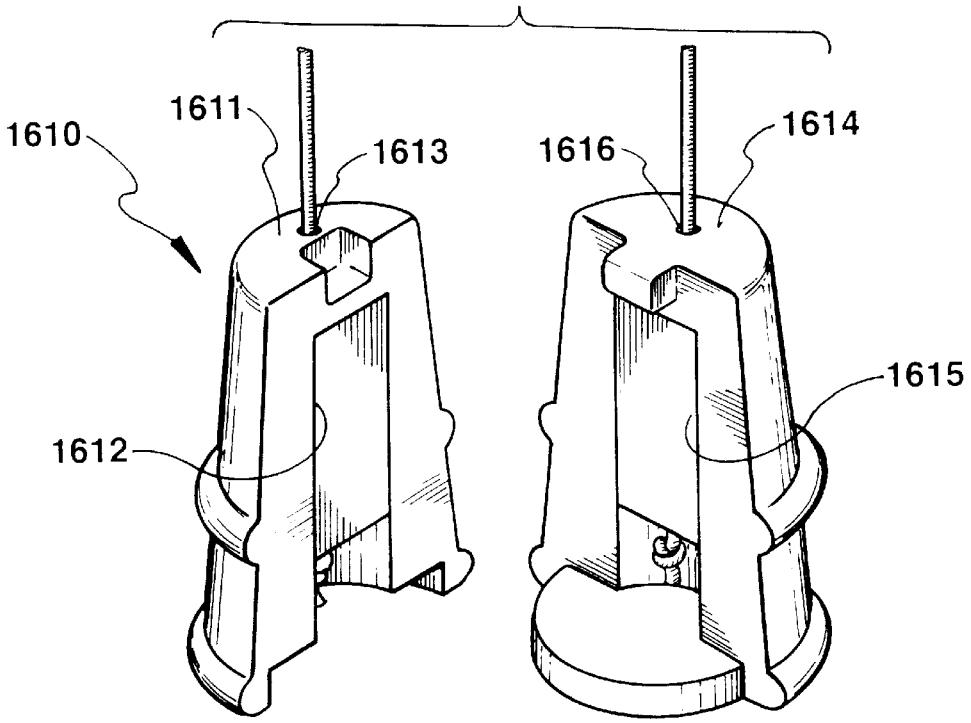
FIG. 34 is a schematic fragmentary exploded perspective view of an improved window covering cord pull safety device according to the first embodiment.
Figure 35:
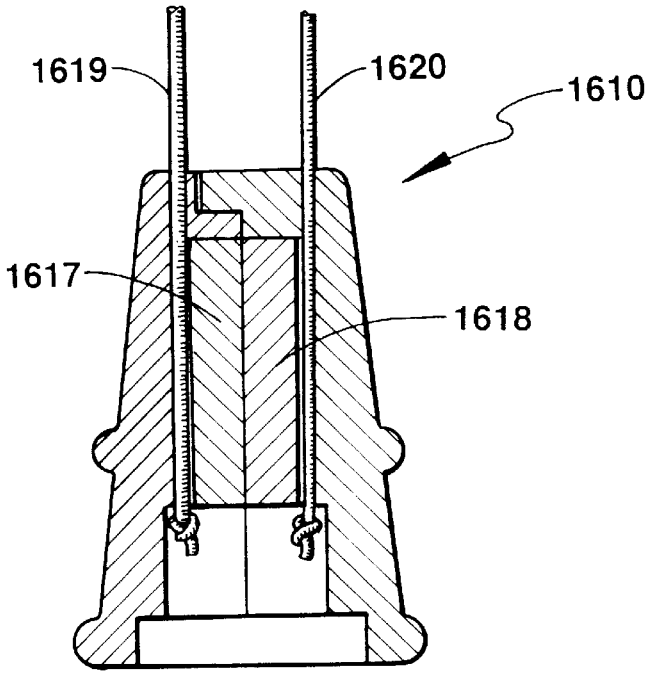
FIG. 35 is an elevational view in cross-section of the improved window covering cord pull safety device of FIG. 34 which includes a first member, a second member, a first plate and a second plate.
Figure 36:
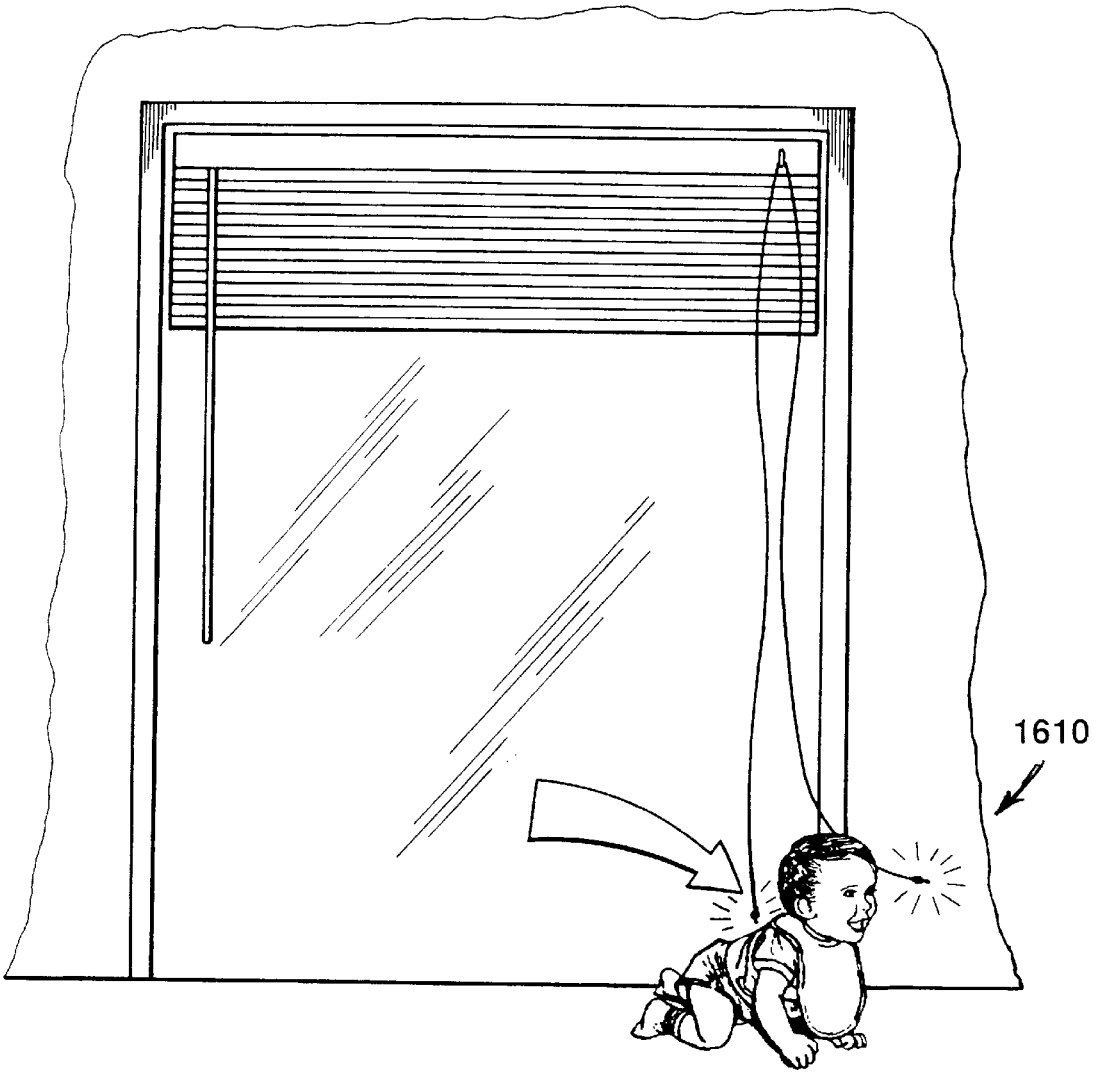
FIG. 36 is a schematic view illustrating the safety action the improved window covering cord pull safety device of FIG. 34.

Referring to FIG. 34 in conjunction with FIG. 35 and FIG. 36 an improved window covering cord pull safety device 1610 includes a first member 1611 having a cavity 1612 and a bore 1613, a second member 1614 having a cavity 1615 and a bore 1616. The second member 1614 is disengagably coupled to the first member 1611. The improved window covering cord pull safety device 1610 also includes a conductive, magnetic plate 1617, a conductive, magnetizable plate 1618, a first length 1619 of a pull cord with a conductive wire disposed therein and a second length 1620 of a pull-cord with a conductive wire disposed therein. The conductive, magnetic plate 1617 is disposed in the cavity 1612 of the first member 1611. The conductive, magnetizable plate 1618 is disposed in the cavity 1615 of the second member 1614. The first length 1619 of the pull cord has a first end 1621 and a second end 1622. The second length 1620 of the pull cord has a first end 1623 and a second end 1624. The first and second lengths of the pull cord are disposed in the bores 1613 and 1616 of the first and second members 1611 and 1614, respectively. The conductive wires adjacent to the first ends 1621 and 1623 of the first and second lengths 1619 and 1620 of the pull cord are electrically coupled to the conductive, magnetic plate 1617 and the conductive, magnetizable plate 1618, respectively. The second ends 1622 and 1624 of the first and second lengths 1619 and 1620 of the pull cord are electrically coupled to an alarm system 1625 through an alarm circuit 1626. The improved window covering cord pull safety device 1610 is similar to the window covering cord pull safety device which U.S. Pat. No. 4,909,298 teaches. The safety action of the improved window covering cord pull safety device 1610 is accomplished by its not only breaking apart in the first and second members 1611 and 1614 when the neck of an infant is caught between the first and second lengths 1619 and 1620 of the pull cord, but also its triggering the alarm system 1623 simultaneously.

From the foregoing it can be seen that a combined alarm system and window covering assembly has been described. It should be noted that the drawings are not drawn to scale and that distances between the figures and their relative sizes are not to be considered significant.

It is intended that the foregoing descriptions and showings made in the drawings shall be considered only as an illustration of the principles of the present invention and may be embodied in a variety of forms by one skilled in the art.

What is claimed is:

1. A combined alarm system and window covering assembly comprising:

a. a top housing;

b. a bottom rail having two ends;

c. a covering mechanically coupled to said top housing and said bottom rail;

d. an alarm element extending from said top housing down to said bottom rail and up from said bottom rail to said top housing;

e. a pull cord for raising and lowering said bottom rail, said pull cord being coupled to said top housing; and f. an enclosure which is fixedly coupled one of said two ends of aid bottom rail;

g. a reed relay switch electrically coupled to said alarm element, said reed relay switch being resiliently coupled to said enclosure and fixedly coupled to said pull cord whereby said reed relay switch resiliently couples said pull cord to said bottom rail.

2. A combined alarm system and window covering assembly according to claim 1 wherein said alarm element is a conductive wire which is disposed in said pull cord.

3. A combined alarm system and window covering assembly according to claim 2 wherein said resiliently biased reed relay switch is electrically coupled to said conductive wire.

4. A resiliently biased reed relay switch for coupling a pull cord to a bottom rail having two ends in a combined alarm system and window covering assembly having an alarm element, said resiliently biased reed relay switch comprising:

a. a tube having a first end and a second end which is crimped, said tube being mechanically coupled to one of said two ends of said bottom rail;

b. an encapsulated reed relay switch being fixedly coupled to said pull cord and slidably disposed within said tube, said encapsulated reed relay switch having a first end with a first conductive lead and a second end with a second conductive lead and both of said first and second conductive leads being electrically coupled to the alarm element; and c. a spring having a first end and a second end, said spring being disposed in said tube so that said first end of said spring is adjacent to said second end of said tube and said second end of said spring is adjacent to said first end of said encapsulated reed relay switch whereby said resiliently biased reed relay switch resiliently couples said pull cord to said bottom rail.

5. A resiliently biased reed relay switch according to claim 4 wherein said alarm element is a conductive wire which is disposed in said pull cord.

6. A resiliently biased reed relay switch according to claim 5 wherein said first and second conductive leads are electrically coupled to said conductive wire.

7. A magnet holding and bottom rail bracket for use with a resiliently biased reed relay switch, said magnet holding and bottom rail bracket comprising:

a. a bracket having a base, a support and a flange having a hole, said base, said support and said flange being orthogonally disposed to each other, said support being fixedly coupled to said base and said flange being fixedly coupled to said support;

b. a disc-shaped magnet having a hole therein, said hole in said disc-shaped magnet being aligned with said hole in said flange and being fixedly coupled to said flange whereby said disc-shaped magnet interacts with the resiliently biased reed relay switch.

8. A magnet holding and bottom rail bracket according to claim 7 for use in a combined alarm system and window covering assembly having a bottom rail having two ends and an alarm element, wherein said resiliently biased reed relay switch includes:

a. a tube having a first end and a second end which is crimped, said tube being mechanically coupled to one of said two ends of said bottom rail;

b. an encapsulated reed relay switch being fixedly coupled to said pull cord and slidably disposed within said tube, said encapsulated reed relay switch having a first end with a first conductive lead and a second end with a second conductive lead and both of said first and second conductive leads being coupled to said alarm element;

c. a cap having a disc-shaped portion which is fixedly coupled to said second end of said encapsulated reed relay switch and a rod-shaped portion which engages said hole in said flange;

d. a spring having a first end and a second end, said spring being disposed in said tube so that said first end of said spring is adjacent to said second end of said tube and said second end of said spring is adjacent to said first end of said encapsulated reed relay switch whereby said resiliently biased reed relay switch resiliently couples said pull cord to said bottom rail.

* * * * *